US010512917B2

(12) United States Patent
Watkins et al.

(10) Patent No.: US 10,512,917 B2
(45) Date of Patent: Dec. 24, 2019

(54) MILL

(71) Applicant: Mineworx Technologies, Ltd., Burnaby (CA)

(72) Inventors: Gavin Watkins, Coquitlam (CA); Duane Nelson, North Vancouver (CA)

(73) Assignee: Mineworx Technologies Ltd., Burnaby, British Columbia (CA)

( * ) Notice: Subject to any disclaimer, the term of this patent is extended or adjusted under 35 U.S.C. 154(b) by 523 days.

(21) Appl. No.: 15/063,725

(22) Filed: Mar. 8, 2016

(65) Prior Publication Data

US 2017/0259270 A1 Sep. 14, 2017

(51) Int. Cl.

| | |
|---|---|
| ***B02C 13/00*** | (2006.01) |
| ***B02C 13/28*** | (2006.01) |
| ***B02C 13/12*** | (2006.01) |
| ***B02C 13/288*** | (2006.01) |
| ***B02C 23/12*** | (2006.01) |
| ***B02C 23/32*** | (2006.01) |
| ***B02C 23/24*** | (2006.01) |
| ***B02C 13/13*** | (2006.01) |
| ***B02C 13/282*** | (2006.01) |
| ***B02C 13/06*** | (2006.01) |

(52) U.S. Cl.

CPC ..... *B02C 13/28* (2013.01); *B02C 13/06* (2013.01); *B02C 13/12* (2013.01); *B02C 13/13* (2013.01); *B02C 13/282* (2013.01); *B02C 13/2804* (2013.01); *B02C 13/288* (2013.01); *B02C 23/12* (2013.01); *B02C 23/24* (2013.01); *B02C 23/32* (2013.01); *B02C 2013/2825* (2013.01)

(58) Field of Classification Search

CPC ..... B02C 23/24; B02C 23/26; B02C 23/32; B02C 17/16; B02C 17/1855

See application file for complete search history.

(56) References Cited

U.S. PATENT DOCUMENTS

| | | | | |
|---|---|---|---|---|
| 2,873,920 A * | 2/1959 | Holm | B02C 13/00 241/183 |
| 3,682,399 A | 8/1972 | Kaspar et al. | |
| 3,966,130 A * | 6/1976 | Doty | B02C 7/00 241/285.1 |

(Continued)

OTHER PUBLICATIONS

International Search Report for PCT/IB2017/000877 dated Nov. 7, 2017, 4pgs.

Written Opinion for PCT/IB2017/000877 dated Nov. 7, 2017, 3pgs.

*Primary Examiner* — Faye Francis

(74) *Attorney, Agent, or Firm* — Merchant & Gould P.C.

(57) ABSTRACT

A mill includes a housing with a first end portion, a second end portion, and a lateral area disposed therebetween. The housing includes a raw material inlet, an air inlet, a recirculated material inlet, and a material outlet. An impeller is supported by the housing and includes a shaft disposed along the longitudinal axis of the housing, with a plurality of curved blades. A method for milling includes receiving a material of a first size range, introducing the material to an apparatus via a first inlet and introducing air into the apparatus via a second inlet. The method also includes agitating the material via an impeller, where the agitation reduces at least some of the material to a second size range by the time the material reaches an outlet of the apparatus. The processed material is delivered to subsequent processing operations.

9 Claims, 19 Drawing Sheets

(56) References Cited

U.S. PATENT DOCUMENTS

| | | | | | |
|---|---|---|---|---|---|
| 4,061,274 | A * | 12/1977 | Williams | B02C 21/00 | 241/19 |
| 4,166,583 | A * | 9/1979 | Ruckstuhl | B02C 13/20 | 241/154 |
| 5,279,466 | A * | 1/1994 | Williams | B02C 23/32 | 209/139.1 |
| 5,330,112 | A * | 7/1994 | Nagaoka | B02C 17/16 | 241/172 |
| 5,381,968 | A * | 1/1995 | Lohnherr | B02C 23/32 | 241/119 |
| 5,649,667 | A * | 7/1997 | Folsberg | B02C 15/06 | 241/122 |
| 5,695,130 | A * | 12/1997 | Csendes | B02C 13/18 | 241/162 |
| 5,826,807 | A * | 10/1998 | Csendes | B01D 45/14 | 241/19 |
| 8,141,804 | B1 * | 3/2012 | Young | B02C 13/28 | 241/194 |
| 2002/0162207 | A1 * | 11/2002 | Yotsumoto | B02C 13/28 | 29/426.4 |
| 2008/0245914 | A1 * | 10/2008 | Yang | B02C 13/08 | 241/191 |
| 2010/0213301 | A1 * | 8/2010 | Hoice | B02C 13/04 | 241/293 |
| 2010/0327096 | A1 * | 12/2010 | Watts | B02C 13/1814 | 241/56 |
| 2012/0175447 | A1 * | 7/2012 | Sutti | B02C 1/04 | 241/198.1 |
| 2012/0234953 | A1 * | 9/2012 | Risi | B02C 13/28 | 241/285.1 |

* cited by examiner

MILL

BACKGROUND

Mining systems generally include many large-scale systems and subsystems used to classify and process various sediment types, thereby extracting heavy or previous metals from sediment. Mined raw materials include rock, dirt, sand, and alluvial. Such mining systems process the mined raw materials to isolate the valuable substances from low value substances in the matrix using physical and/or chemical separation methodologies. It is with respect to this general environment that the embodiments of the present application are directed.

SUMMARY

In summary, the present disclosure relates to a mill apparatus for reducing the size of received raw materials. In some of the various embodiments discussed herein, the mill apparatus can be transported to and used in remote locations where constructing a large-scale mill is unfeasible or prohibitively expensive.

In a first aspect, a mill for reducing the size of raw mining materials includes a housing having a first end portion, a second end portion opposite the first end portion, a lateral area disposed between the first end portion and the second end portion, and an impeller positioned within the housing. The housing includes a material inlet, an air inlet, a material outlet, and a recirculated material inlet. The impeller includes a shaft disposed along a longitudinal axis, a plurality of blades, and a plurality of blade supports extending radially from the shaft and supporting the plurality of blades.

In a second aspect, a method of milling raw mining material is disclosed. The method includes receiving raw mining material having a first size range, introducing the raw mining material to an apparatus via a first inlet, the apparatus having an interior, introducing air into the apparatus via a second inlet, agitating the raw mining material via an impeller, where agitating reduces at least some of the raw mining material to a second size range by at least when the raw mining material reaches an outlet, where the second size range is lesser than the first size range, and delivering the agitated raw mining material to a subsequent processing operation via the outlet.

In a third aspect, an apparatus includes a mill for reducing a size of a raw mining material. The mill includes a housing having a first end portion, a second end portion, a lateral portion disposed between the first end portion and the second end portion, an impeller including a shaft, a first inlet configured to receive the raw material, the first inlet positioned near the first end portion, a second inlet configured to receive air, the second inlet positioned near the first end portion and adjacent to the shaft, a third inlet configured to receive raw material from a different source than the raw material received at the first inlet, and an outlet positioned near the second end portion. A cross section of the lateral portion is a regular polygon with a centroid. The mill also includes a first bearing positioned near the first end portion and a second bearing positioned near the second end portion, where the first bearing and the second bearing both support the shaft such that the centroid of a longitudinal axis of the shaft is aligned with the centroid of the lateral portion.

DETAILED DESCRIPTION

As briefly described above, embodiments of the present invention are directed to a portable mill apparatus as well as a process for its use. In the various embodiments discussed herein, the portable mining apparatus can be transported to and used in remote locations where constructing a large-scale mill is unfeasible or prohibitively expensive.

Figure 1:
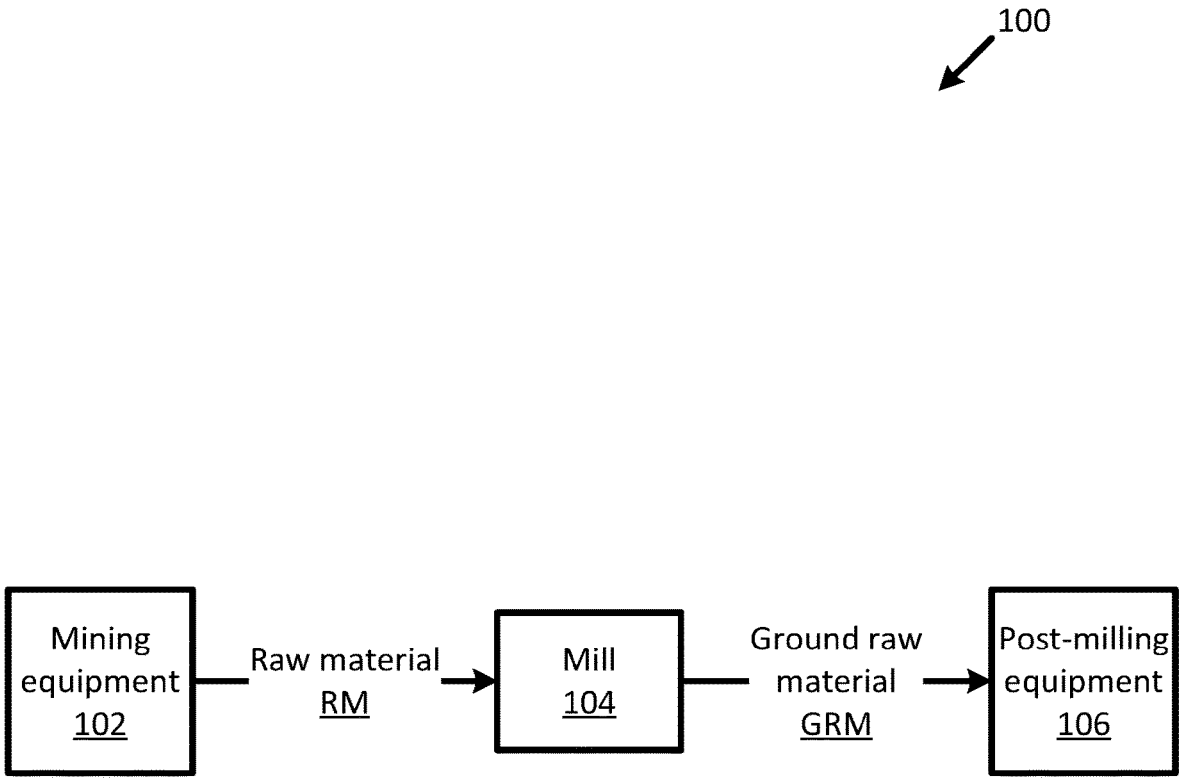
FIG. 1 is a general-purpose block diagram of a mining environment according to an example embodiment of the present disclosure.

In accordance with the present disclosure, FIG. 1 illustrates a general block diagram of an embodiment of an example mining environment 100 for using a mill 104. The example mining environment 100 includes mining equipment 102, mill 104 receiving raw material RM, and post-milling equipment 106 receiving ground raw material GRM. In the embodiment shown, the mill 104 is used at or near the mining site to break down and/or grind and/or reduce the size of and/or achieve communition of materials to a desired fraction of the original size. Other embodiments can include more or fewer components.

Mining equipment 102 can include any machine used to dislodge sediment from its natural state, physically and/or chemically alter the sediment, and transport the sediment to mill 104. For example, mining equipment 102 can include a steam shovel placing raw material into a dump truck, the dump truck transporting the raw material to an on-site hopper, the hopper feeding the raw material to one or more crushers, such as a jaw mill and/or a hammer mill. The raw material additionally may have undergone one or more wetting operations, separation steps, chemical treatments, and/or drying operations.

Generally, the raw material RM fed to mill 104 is not entrained, or not required to be entrained, within a liquid. That is, dry raw material RM is fed into mill 104. Raw material RM can include metals, such as heavy metals or precious metals, contained within rock, alluvial, or other carrier material.

Raw material RM has a size range of about 1 inch to about 0.1 inch; about 0.75 inch to about 0.2 inch; about 0.5 inch to about 0.25 inch; about 0.6 inch to about 0.375 inch; or about 0.4 inch to about 0.125 inch. These sizes represent an approximated diameter of at least half of a random sampling of raw material, realizing that mined raw materials are not perfectly spherical or polyhedral and variations will necessarily exist between any two given pieces of raw material. In many instances, the raw material RM has passed through one or more crushing apparatus before reaching mill 104 to be within the size ranges listed above.

Raw material RM is fed into mill 104. A hopper, conveyor belt, or other delivery component can be used to introduce raw material RM into mill 104. Mill 104 reduces the average size of raw material RM to produce ground raw material GRM Ground raw material GRM is then fed to post-milling equipment 106. Post-milling equipment 106 includes physical and chemical separation operations. For example, ground raw material GRM exiting mill 104 next enters a series of cyclones that separates out oversized material that should be re-routed back to the mill 104. In embodiments, the post-milling equipment includes primary and secondary separators tailed to the specific grind required to optimize liberation of the desired material, which can reduce the necessity of re-grinding already-acceptable particles. Having this tailoring can increase throughput as compared to a system without this selective recirculation system. Additional examples of post-milling equipment 106 are discussed below.

Figure 2:
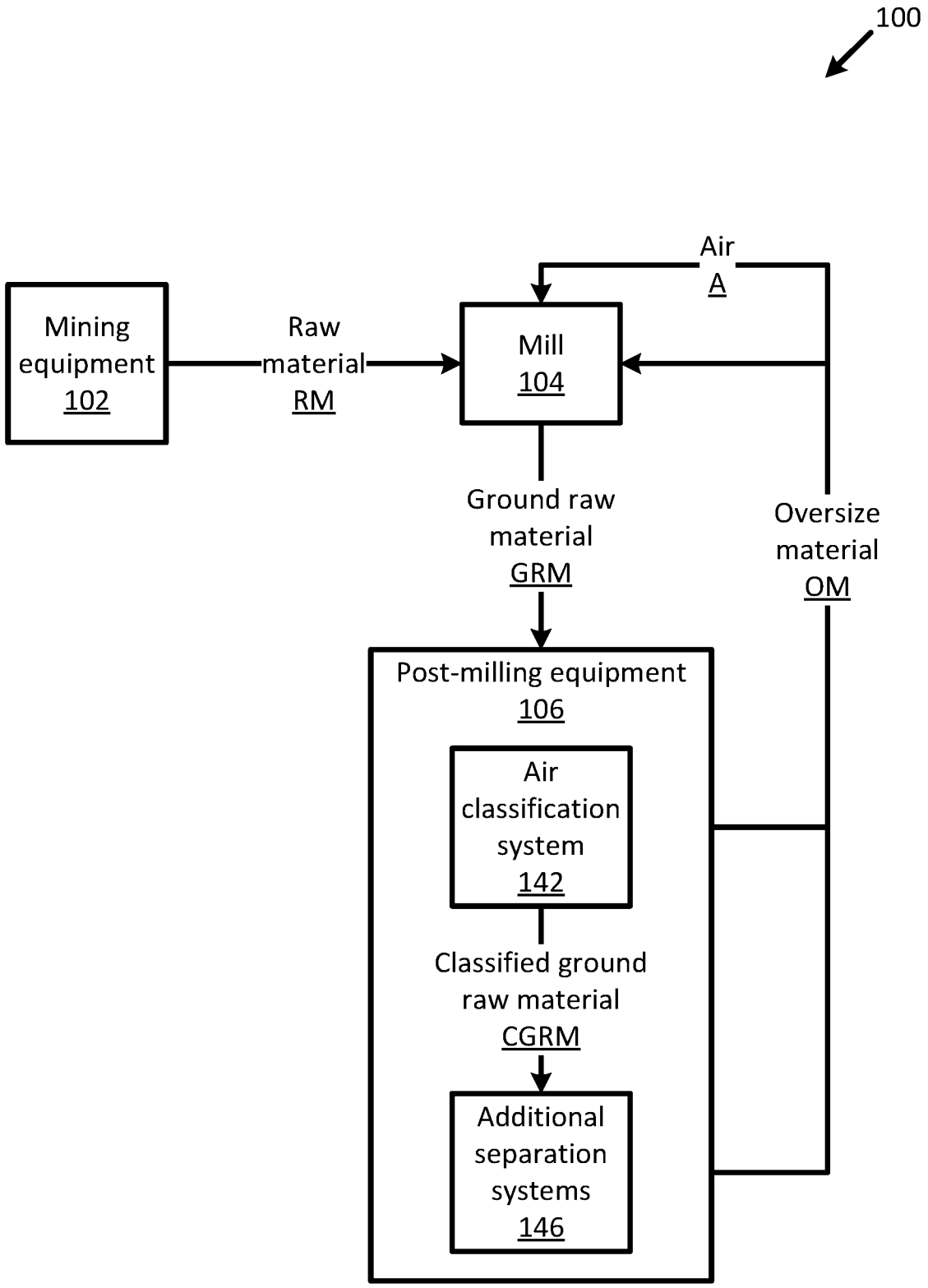
FIG. 2 is a block diagram illustrating a general progression of mining materials through the example mining environment 100 shown in FIG. 1.

FIG. 2 is a block diagram illustrating a general progression of mining materials through the example mining environment 100 shown in FIG. 1. The general progression includes mining equipment 102 introducing raw material RM into mill 104, air A entering mill 104 via an air inlet, ground raw material GRM exiting mill 104 and entering post-milling equipment 106, which includes air classification system 142 and additional separation systems 146. Air classification system 142 sends oversize material OM back to mill 104 and classified ground raw material CGRM to additional separation systems 146. Processing raw materials RM in mill 104 causes communition, which reduces the size of the particles and increases the surface area of solids. Further, communition can free useful materials from the matrix materials in which they are embedded. Other embodiments can include more or fewer components.

As discussed above, mining equipment 102 provides the raw material RM input to mill 104. Raw material RM enters mill 104 through a solids inlet. Air A enters mill 104 through an air inlet. In embodiments, mill 104 provides enough air flow and pressure to the air classification system 142, and therefore, the air circuit is essentially a closed loop. Air A exiting additional separation systems 146 is fed back into the vacuum condition existing at the front center of the impeller.

In embodiments, air A exiting air classification system 142 is additionally fed back into mill 104. The differential between the high pressure condition present at the outlet flange of mill 104 and the low pressure condition existing at the front center of the impeller constitutes the pressure differential across the air classification system 142 and/or additional separation systems 146.

In embodiments, an air pump, not shown, is added to the system 100 between the post milling equipment 106 and the return air inlet on mill 104. The air pump is configured to evacuate air from the line connecting the post milling equipment 106 and the air inlet on mill 104, thereby causing a slight net loss of air volume within the system. This slight net loss of air volume can prevent air, and consequently, dust, from exiting the RM inlet opening.

Within mill 104, raw material RM moves from an inlet portion to an outlet portion via air A and an impeller. An embodiment of example mill 104, including embodiments of the various inlets and outlets and impeller, is shown in, and described below with reference to, FIGS. 2-13.

As raw material RM moves through mill 104, raw material RM may be reduced in size because of the impacts between the raw material RM and the interior walls of mill 104 as well as impacts between the particles themselves. The impeller increases the speed of the particles directly and indirectly: directly when the blades of the impeller contact the particles, and indirectly by the centrifugal forces created by the impeller, including one or more vortices created within the housing of mill 104.

After passing through the interior of mill 104, raw material RM and ground raw material GRM exit mill 104 through an outlet. Ground raw material GRM is sized at, or less than, about 0.078 inch (about 2000 μm); about 0.0197 inch (about 500 μm); about 0.0117 inch (about 300 μm); or about 0.0059 inch (about 150 μm).

Adjusting the flow rate of material through mill 104 and/or the rotations per minute of the impeller affects the ground raw material size. In embodiments, the impeller is controlled with a motor outfitted with a variable frequency drive used with a programmable logic circuit, in conjunction with a digital rpm encoder. In embodiments, the throughput of material (flow rate) and the impeller rpm can be optimized for a specific ore or mined raw material.

In embodiments, the outlet is spiral shaped, such as volute shaped. The ground raw material GRM exits mill 104 under pressure and enters post-milling equipment 106.

Post-milling equipment 106 includes one or more processing systems. In the embodiment shown, post-milling equipment 106 includes an air classification system 142 and additional separation systems 146. Air classification system 142 can be an integrated system where centrifugal and cyclonic forces are used to classify the material to a predetermined size. Classified ground raw material CGRM is sent to additional separation systems 146. Additional separation systems 146 can include a series of specialty cyclones for air/solids separation.

Oversize material OM is sent back to mill 104 for further communition. Oversize material OM is introduced into mill 104 via a third inlet. Alternatively, oversize material OM is combined with the raw material RM stream, which is then introduced into mill 104.

Figure 3:
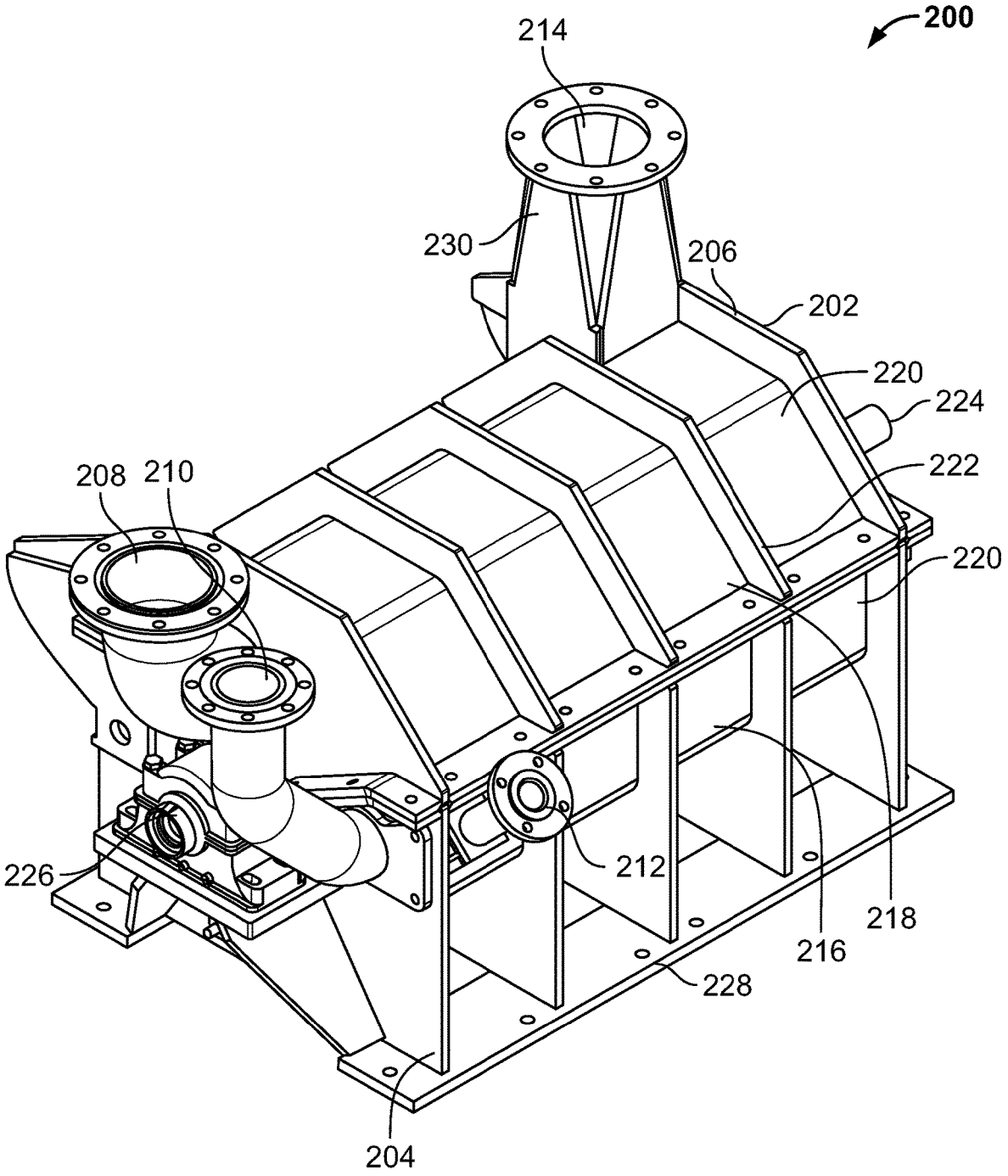
FIG. 3 is a front perspective view of an embodiment of an example mill.

FIG. 3 illustrates a front perspective view of an embodiment of an example mill 200. Mill 200 represents one possible embodiment of mill 104 discussed above in connection with FIGS. 1-2. Example mill 200 includes a housing 202 with a first end portion 204 and second end portion 206, air inlet 208, solids inlet 210, oversized solids inlet 212, outlet 214, lower shell 216, upper shell 218, lateral area 220, support ribs 222, impeller shaft 224, pillow block 226, mount 228, and outlet stack 230. Other embodiments can include more or fewer components and can have components positioned differently.

Figure 4:
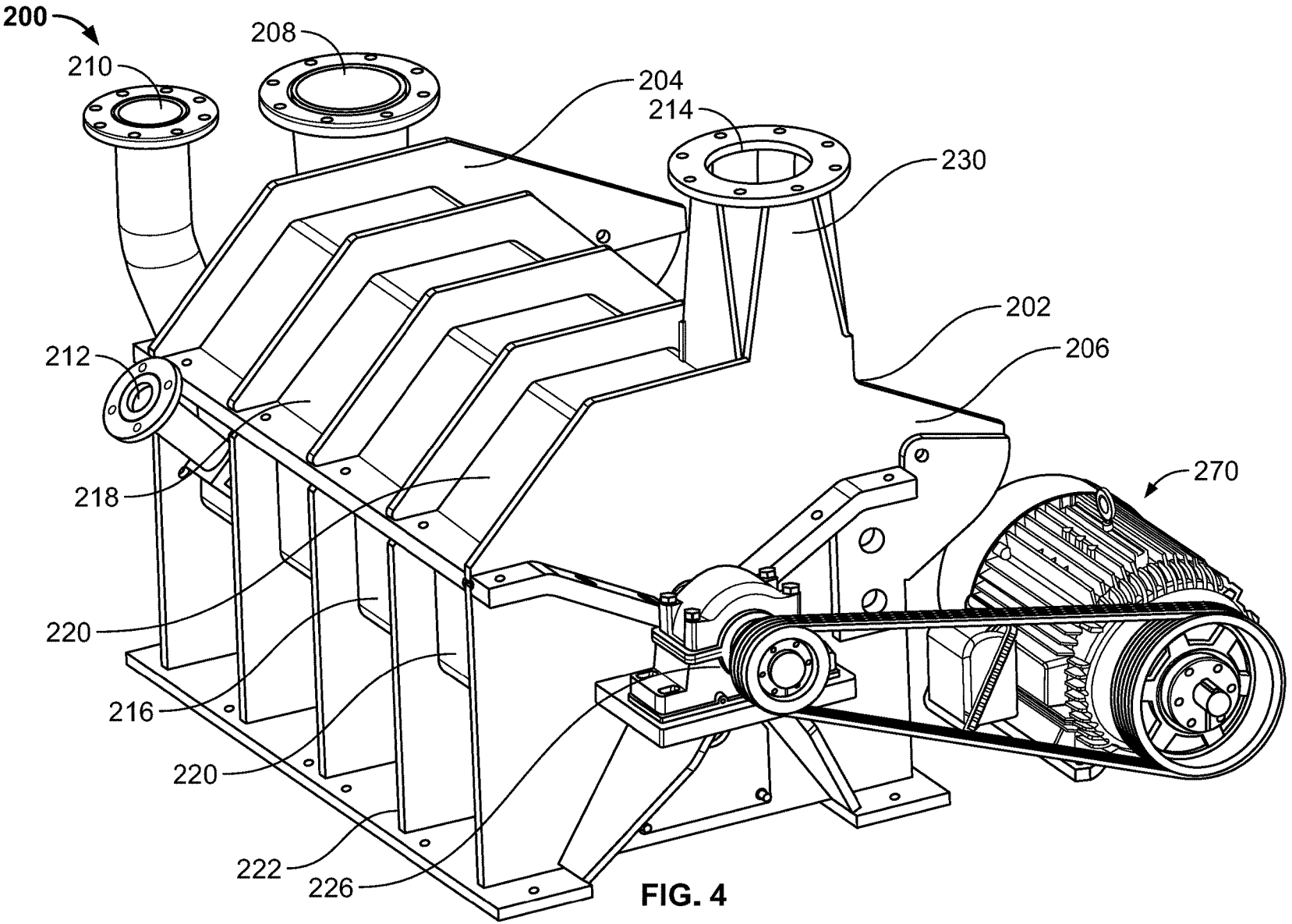
FIG. 4 is a rear perspective view of the embodiment of an example mill shown in FIG. 3, additionally including a motor.
Figure 5:
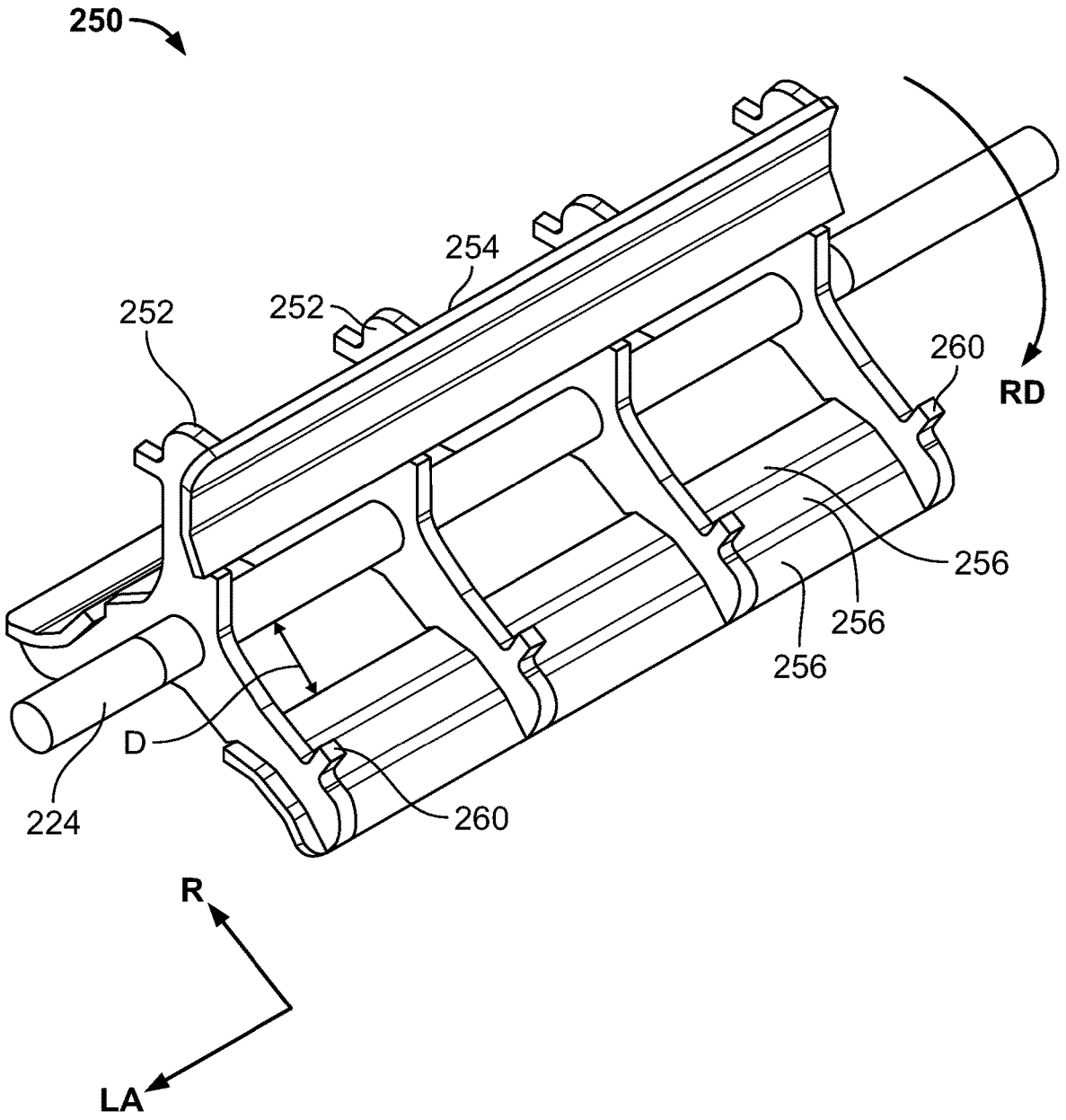
FIG. 5 is a perspective view of an embodiment of an example impeller used in the example mill shown in FIG. 3.
Figure 6:
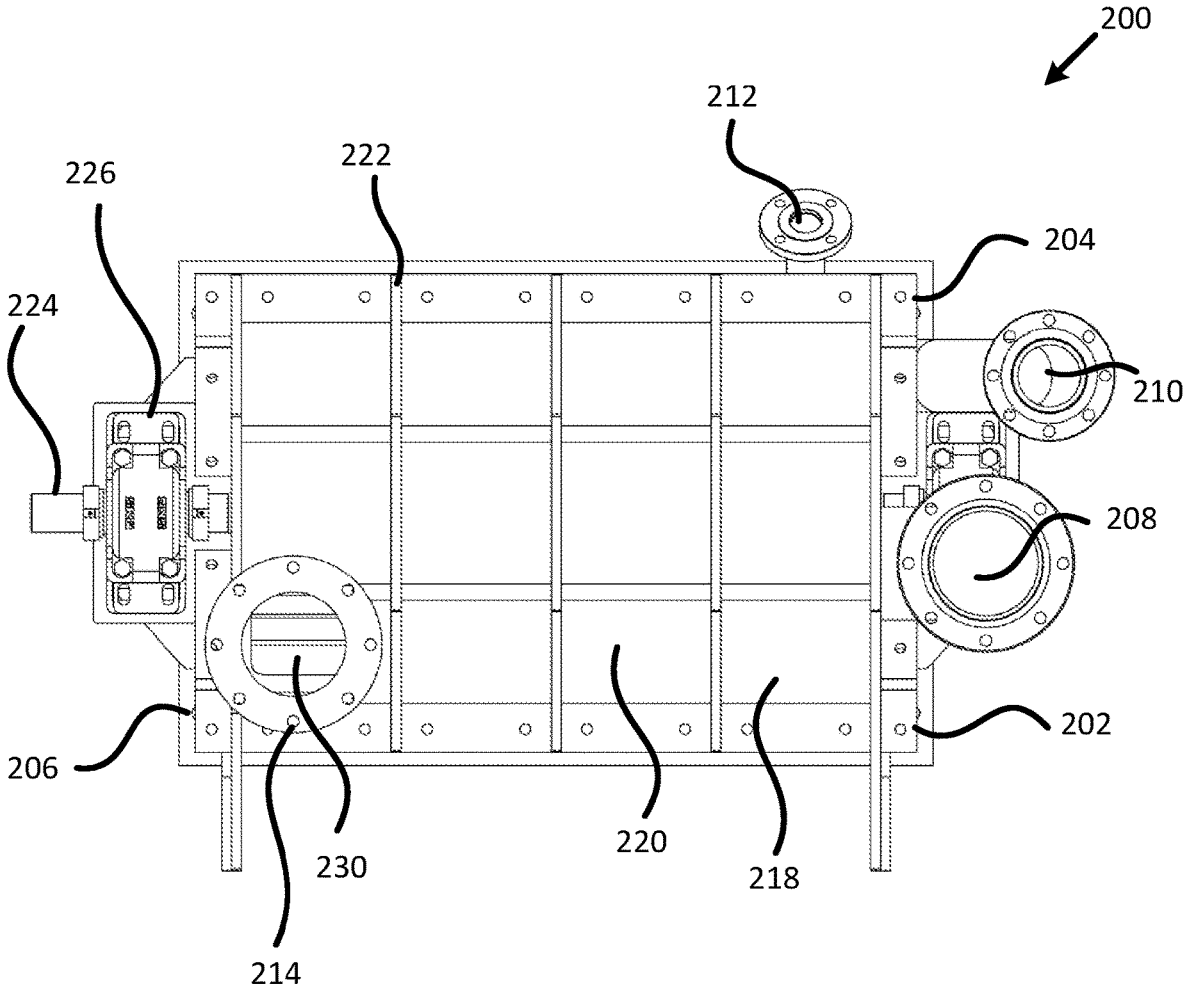
FIG. 6 is a top plan view of the embodiment of an example mill shown in FIG. 3.
Figure 7:
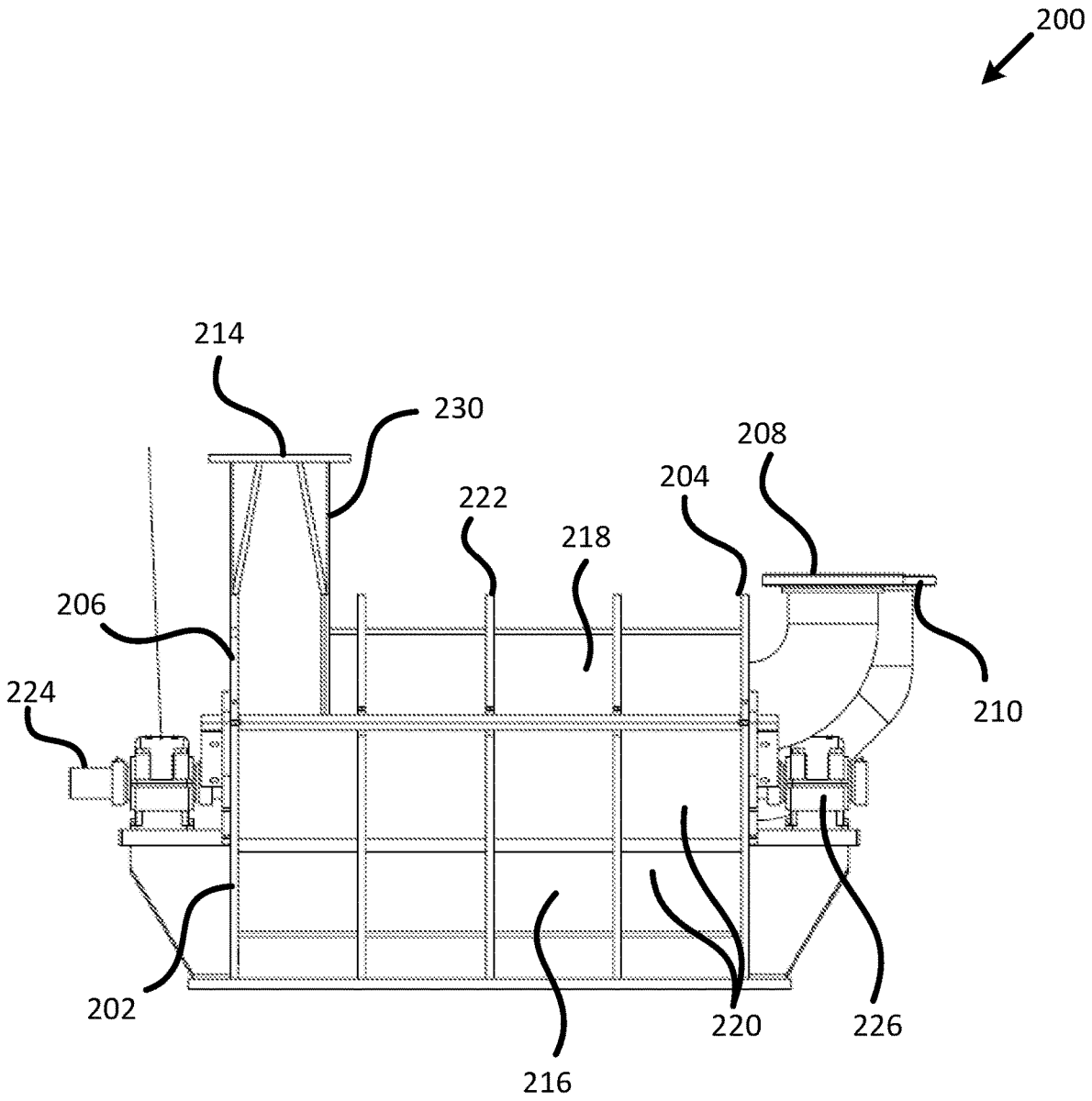
FIG. 7 is a left-side view of the embodiment of an example mill shown in FIG. 3.
Figure 8:
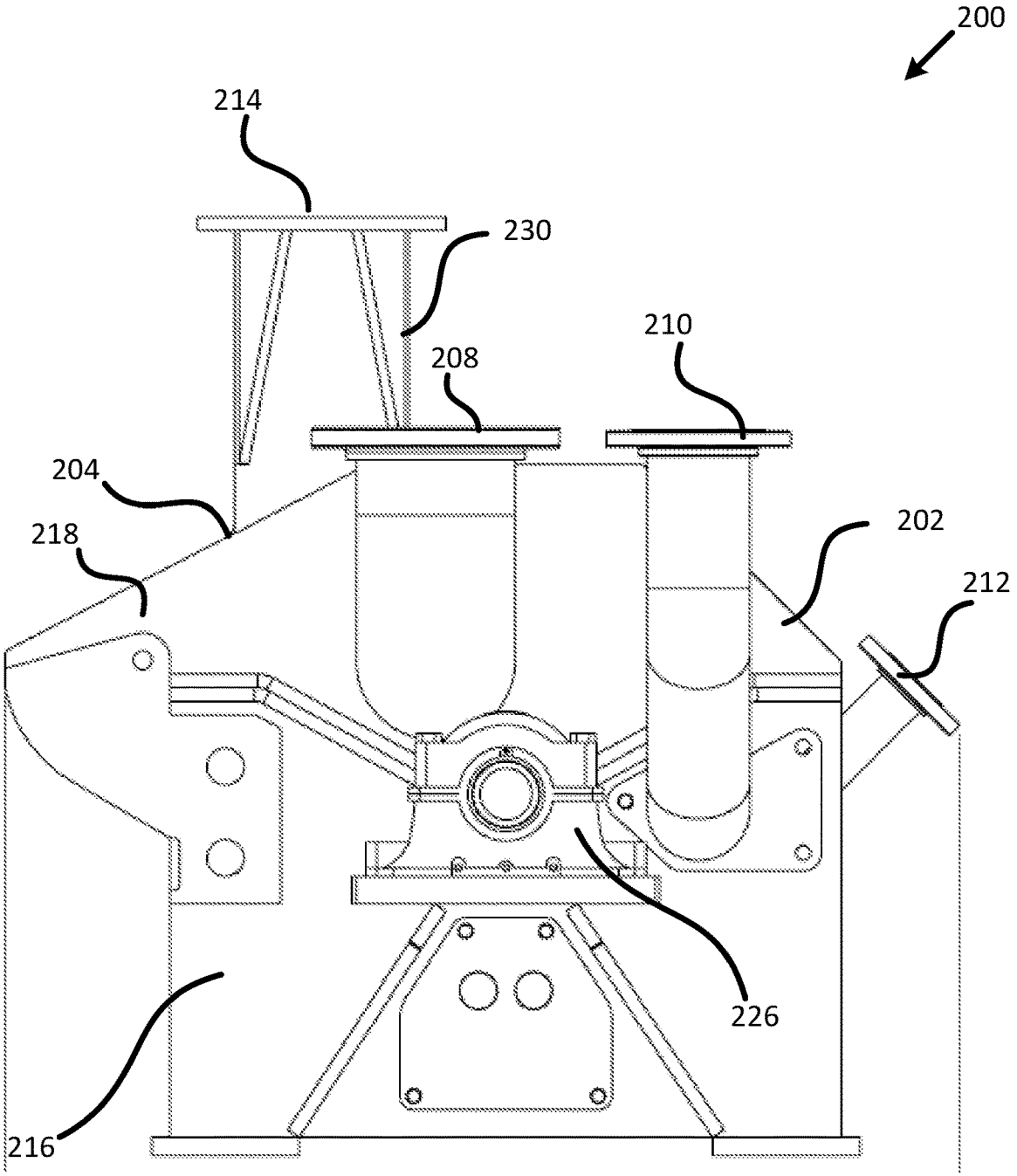
FIG. 8 is a front plan view of the embodiment of an example mill shown in FIG. 3.
Figure 9:
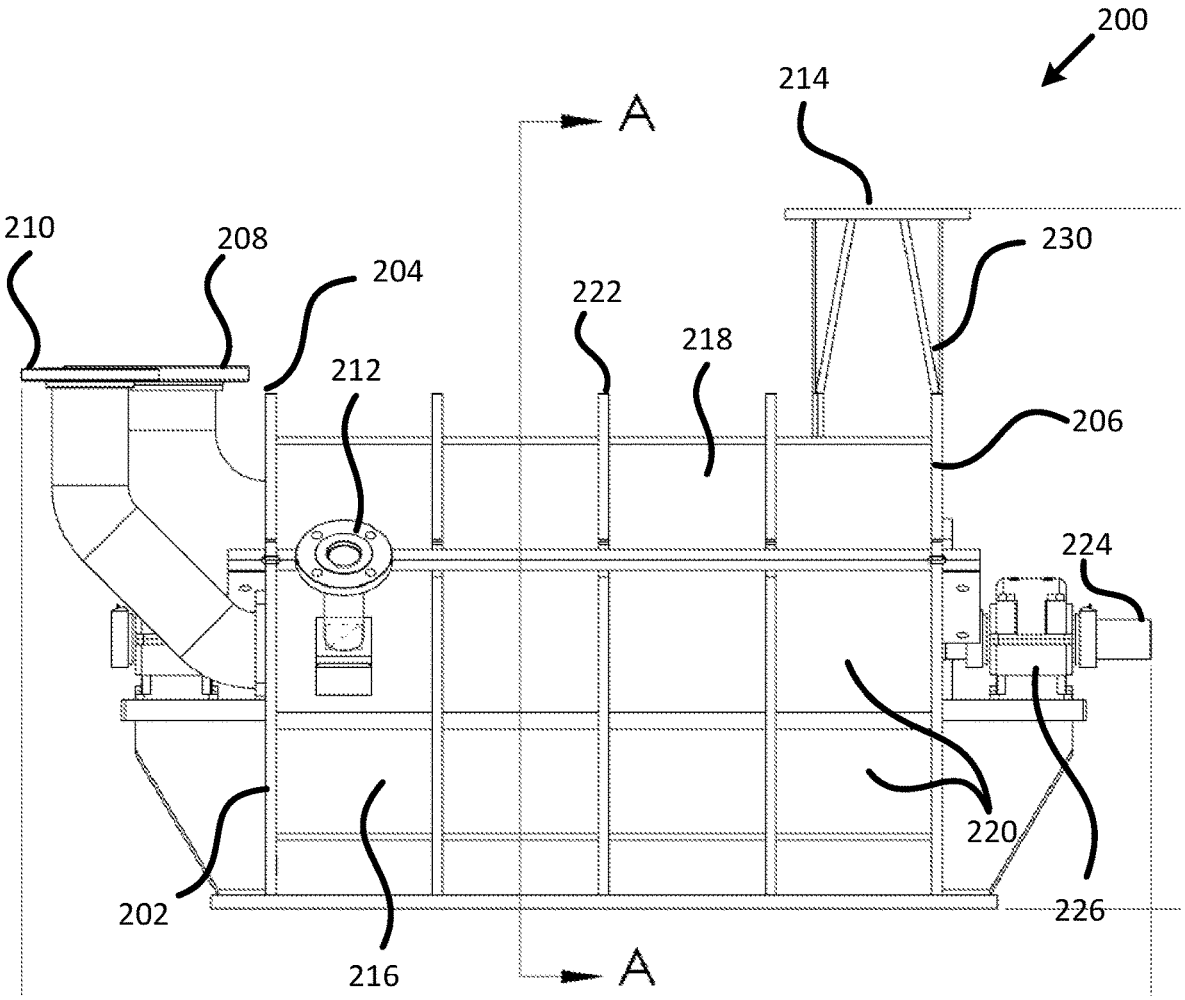
FIG. 9 is a right-side view of the embodiment of an example mill shown in FIG. 3.
Figure 10:
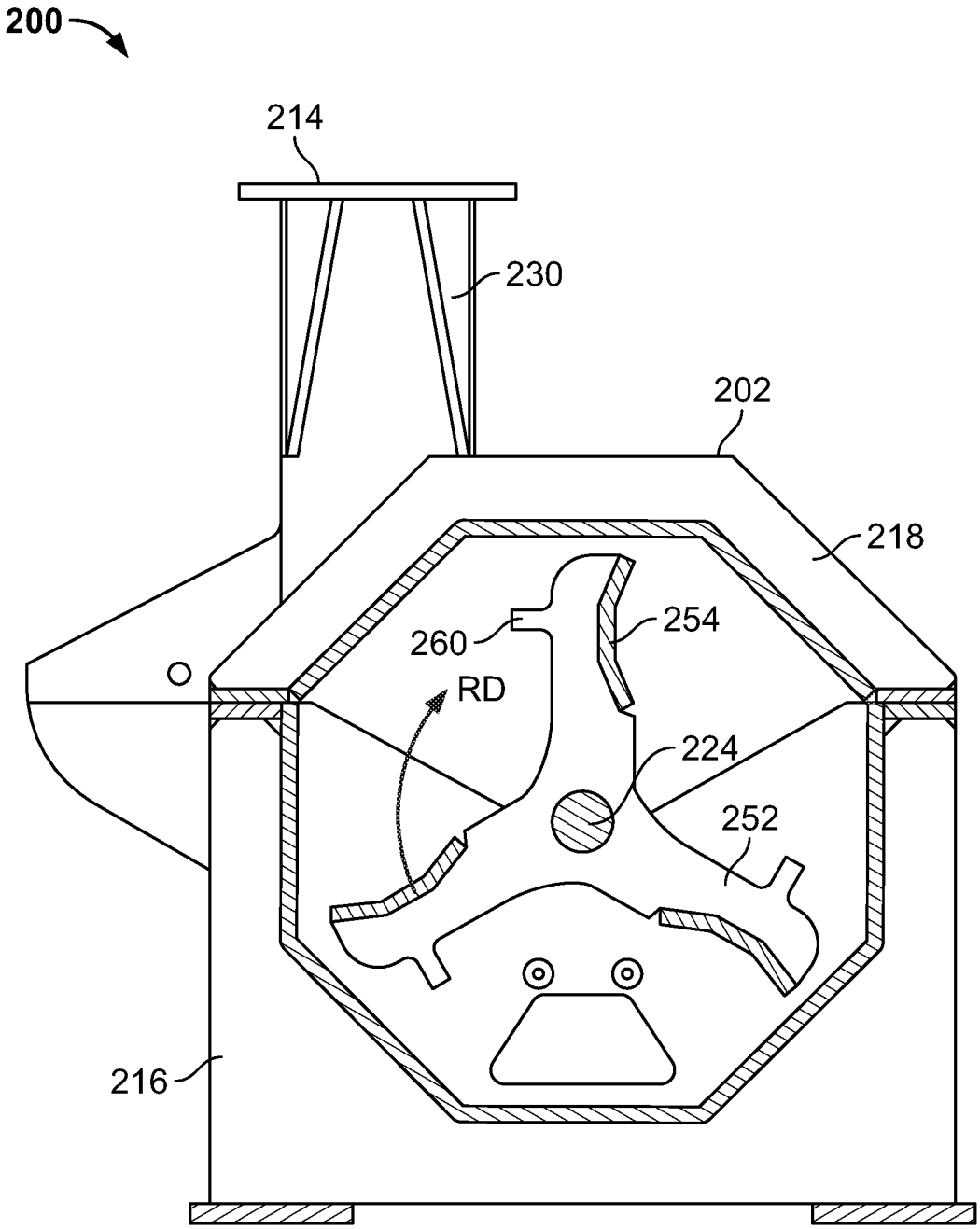
FIG. 10 is a cross-sectional view of the embodiment of an example mill shown in FIG. 3 along axis A shown in FIG. 9.
Figure 11:
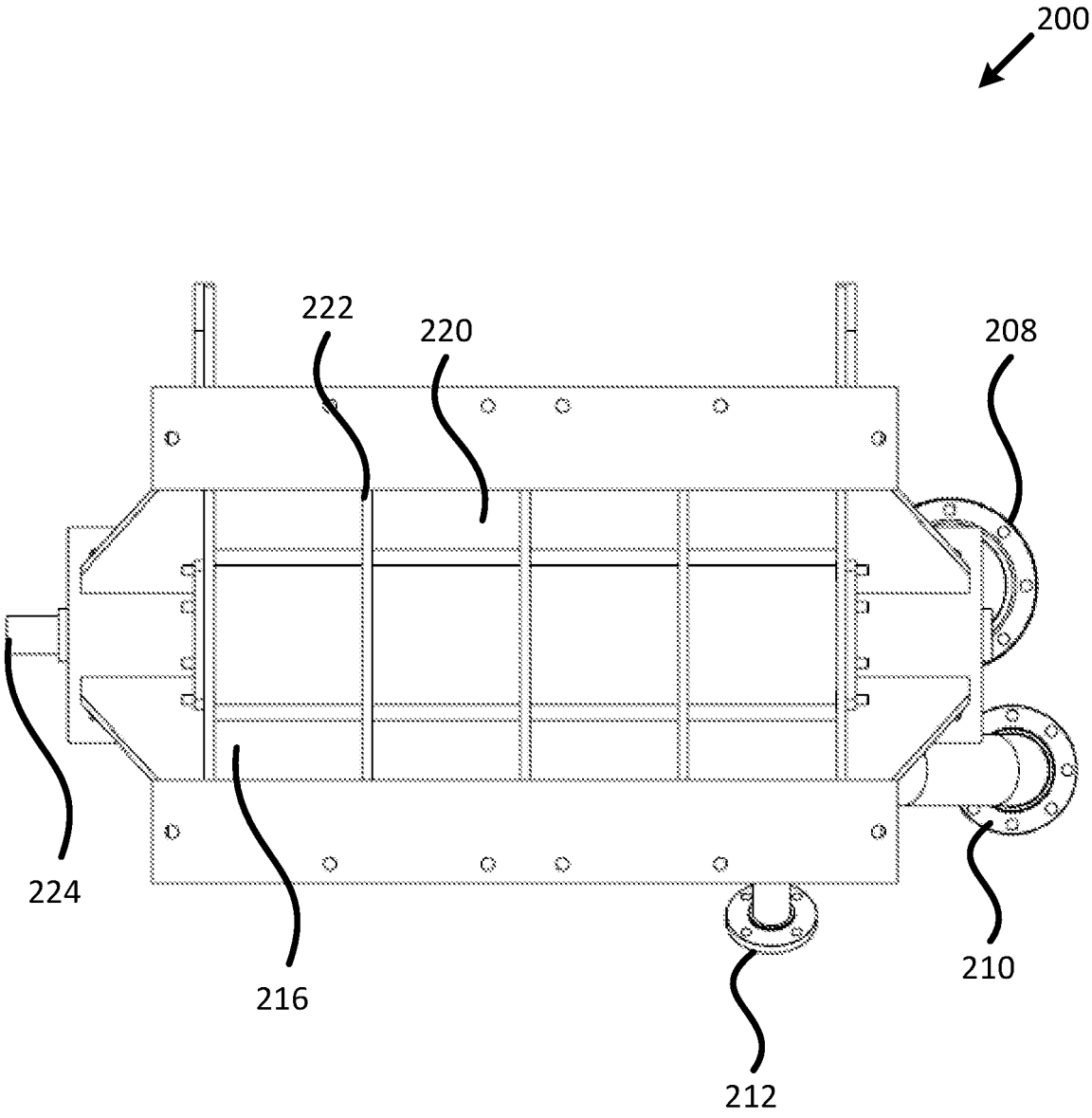
FIG. 11 is a bottom plan view of the embodiment of an example mill shown in FIG. 3.
Figure 12:
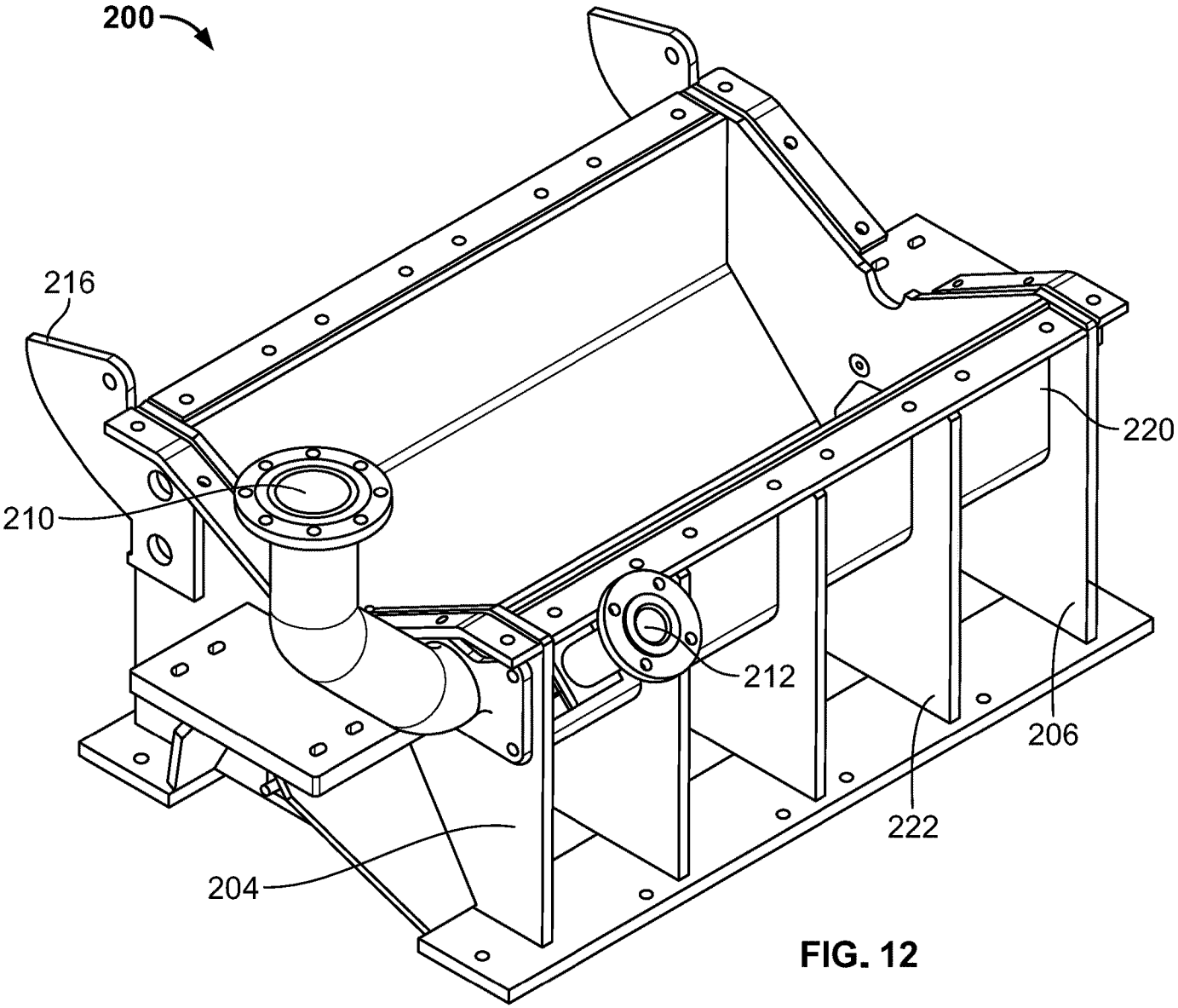
FIG. 12 is a front perspective view of a lower shell and mount of the embodiment of an example mill shown in FIG. 3.
Figure 13:
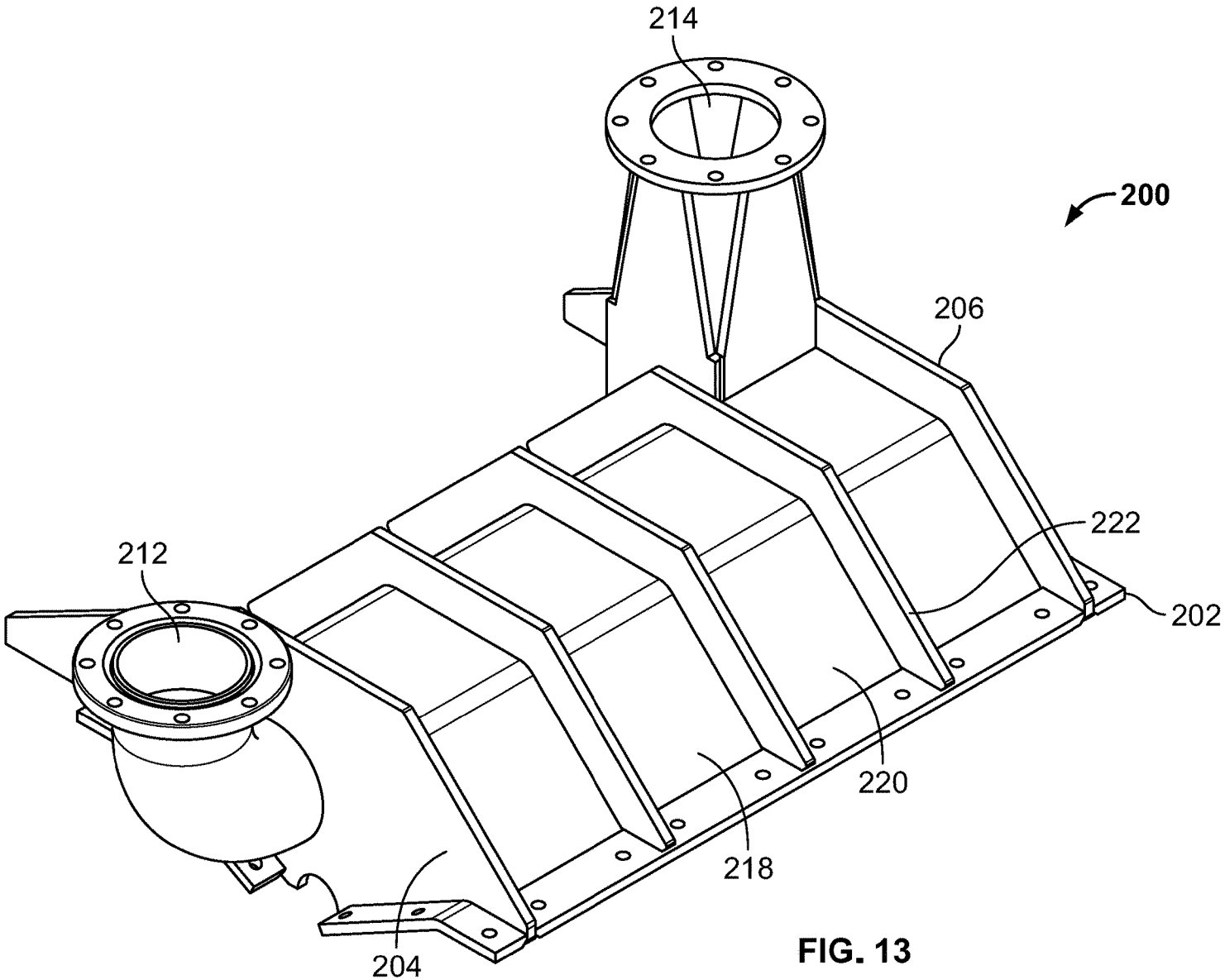
FIG. 13 is a front perspective view of the upper shell of the embodiment of an example mill shown in FIG. 3.

FIG. 4 illustrates a rear perspective view of the example mill 200 shown in FIG. 3 with a motor connected to impeller shaft 224 and configured to cause the impeller shaft 224 to rotate. FIGS. 5-13 illustrate various views of the example mill 200 shown in FIG. 3 as well as its components. Specifically, FIG. 5 illustrates a perspective view of impeller 250, FIG. 6 illustrates a top plan view of mill 200, FIG. 7 illustrates a left-side view of mill 200, FIG. 8 illustrates a front plan view of mill 200, FIG. 9 illustrates a right-side view of mill 200, FIG. 10 illustrates a cross-sectional view of mill 200 along axis A shown in FIG. 9, FIG. 11 illustrates a bottom plan view of mill 200, FIG. 12 illustrates a front perspective view of lower shell 216 and mount 228, and FIG. 13 illustrates a front perspective view of upper shell 218. Unless otherwise noted, the following discussion is with reference to FIGS. 3-12.

In embodiments, mill 200 is relatively smaller than traditional, permanent milling apparatus. Dimensions of various embodiments may differ. Thus, mill 200 is portable and can be moved to different locations within a mining site and from one mining site to a different mining site. Although other embodiments have different dimensions, mill 200, in the embodiment shown, has a length of between about 60 inches to about 90 inches; a width of between about 40 inches to about 65 inches; and a height of about 40 inches to about 65 inches.

Housing 202 contains the raw material fed into mill 200 and supports the impeller 250 (shown in FIG. 5). A first end portion 204 of housing 202 includes air inlet 208, solids inlet 210, oversized solids inlet 212, and pillow block 226. Housing 202 is also formed by upper shell 218 and lower shell 216.

Air inlet 208 introduces air into housing 202 through the first end portion 204 of upper shell 218 and adjacent to a rotational axis of impeller 250. Raw material is introduced into housing 202 through solids inlet 210. Without being bound to a particular theory, the space near impeller shaft 224 is the lowest pressure region within housing 202 during mill operation, the space near impeller blades is a neutral pressure region, and the space near outlet 214 is the highest pressure region.

The combination of air flow and vortices generated by the impeller 250 move the raw material from the first end portion 204 to the second end portion 206. Air enters housing 202 at a flow rate of between about 4000 cubic feet per minute (cfm) and about 8500 cfm; between about 5000 cfm and about 7500 cfm; or between about 5500 cfm and about 6500 cfm. The pressure difference between the inlet end and outlet end of the mill is between about 6 psi and about 22 psi; between about 8 psi and about 20 psi; between about 12 psi and about 16 psi; or between about 6 psi and 16 psi.

Solids enter housing 202 through solids inlet 210 and oversized solids inlet 212. As shown, both inlets 210 and 212 are positioned on lower shell 216 and the material is discharged near a neutral pressure region within housing 202. The embodiment shown has solids inlet 210 and oversized solids inlet 212 positioned on different sides of lower shell 216 and somewhat orthogonal to each other.

Generally, inlet 210 is positioned to have a pressure somewhat equal to the atmospheric pressure acting outside mill 200, in contrast to the relatively high or low pressures existing within the mill 200 and post-milling equipment. Generally, this positioning is chosen to prevent pressurized air and dust from exiting the inlet and also to prevent a vacuum condition from drawing in extra air, which adds volume to the zero net system. The addition of air could cause the need for another system elsewhere to remove the air to maintain a zero net closed circuit.

Generally, inlet 212 is positioned to have approximately the same "high" pressure acting on it as the output 214. This is because, generally, a pressure difference from the inlet to the underflow on a post-milling apparatus, such as a cyclone, is undesirable for operation. Other embodiments can have solids inlet and oversized solids inlet in different locations and relative positions.

Solids exit housing 202 through outlet 214. Outlet 214 includes an outlet stack 230 extending above housing 202. Outlet stack 230 can extend in other directions in other embodiments. In embodiments, outlet stack 230 is volute in shape or has an Archimedean spiral shape, which can enhance the discharge efficiency.

Mill 200 includes a lower shell 216 connected to an upper shell 218. As shown, lower shell 216 and upper shell 218 are separate but are held together via bolts, rivets, or other connectors along their seams. The two-piece construction can facilitate, for example, manufacture of the mill 200, transportation and assembly of the mill 200, repair of the mill 200, and even improve structural integrity.

Lower shell 216 includes a plurality of support ribs 222 connected to mount 228 and lateral area 220. As evidenced by, at least, FIG. 7, the cross section of lateral area 220 is a regular octagon, with five of the eight sides in the lower shell 216 (regular meaning all sides congruent and all interior angles congruent). However, the polygonal cross section can have a different number of sides in other embodiments, such as six sides (hexagonal cross section), seven sides (heptagonal cross section), nine sides (nonagonal cross section), or ten sides (decagonal cross section).

Mount 228 connects mill 200 to a supporting surface so that the mill 200 does not move during operation. Because of mill's 200 relatively compact size, mount 228 enables mill 200 to be connected to a portable apparatus, such as a trailer.

Lateral area 220 of lower shell 216 and upper shell 218 is formed by a plurality of connected planar pieces. The number of planar pieces corresponds to the cross-sectional shape, i.e., if the cross sectional shape is octagonal, lateral area 220 includes eight connected planar pieces. Lateral area 220 panels are hardened steel, although other hardened materials can be used. In embodiments, the inner surface of lateral area 220 further includes a wear plate connected to each planar piece.

Support ribs 222 are connected to lateral area 220 panels and can improve the structural integrity of housing 202. As shown, the planar surfaces of support ribs 222 are oriented normal to the longitudinal axis of impeller shaft 224.

Pillow blocks 226 at the first end portion 204 and the second end portion 206 support impeller shaft 224 and enable rotation of the impeller shaft 224. Different types of mounted bearings can be used in other embodiments.

Impeller shaft 224 is driven by motor 270 operatively connected to impeller shaft 224, shown in FIG. 4. Motor 270 has between about 15 horsepower and 100 horsepower; between about 20 horsepower and about 80 horsepower; or between about 30 horsepower and about 60 horsepower.

Motor 270 is a crusher duty motor with heavy duty bearings and a high start torque, although other types can be used.

The rotation rate of the impeller shaft 224 is variable via a variable frequency drive and programmable logic circuit used with motor 270. Motor 270 rotation is between about 900 rpm and about 1800 rpm. The rpm of the impeller shaft 224 has two interchangeable sets of shivs: the first being 1:1 rotation and providing impeller shaft 224 speeds of between 900 rpm and 1800 rpm, and the second being 2:1 drive rotation and providing impeller shaft 224 speeds of between 1800 rpm and 3600 rpm. Rotational speed of the impeller shaft 224 can be controlled and monitored using a high frequency encoder in the rear end of the impeller shaft 224 that provides real-time rpm data. These data can be fed back to the variable frequency drive and programmable logic circuits in embodiments using those components.

Impeller shaft 224 rotates in the direction of the cupped side of the rotor blade. Rotating this direction cause the volute to work on the exhaust, i.e., in the direction where the volute cross section is increasing. Additionally, the angle of incidence of the cupped faces as the faces impact the particles, and the resulting rebound paths, cause several collision zones in front of the moving blade and against the inner wall of the machine.

FIG. 5 illustrates a perspective view of impeller 250. Impeller 250 includes impeller shaft 224, blade supports 252 including knobs 260, blades 254 including blade components 256. Impeller shaft 224 has a longitudinal axis LA, radial direction R, and rotational direction RD. The components of impeller 250 are hardened steel, although other hardened materials can be used.

As shown, four blade supports 252 are connected to impeller shaft 224 and blade supports 252 are connected to three blades 254. Other embodiments can include more or fewer blade supports 252. The quantity of arms on each blade support 252 corresponds to the quantity of blades 254; thus, each blade support 252 in the embodiment shown includes three arms. The arms of each blade support 252 are equally spaced from each other.

Each blade 254 is formed by three connected blade components 256. Each blade component 256 is substantially planar and the blade component 256 most radially distant includes rounded corners. Blade components 256 are joined together such that the surface formed by the joined blade components 256 is curved. For example, relative to the middle blade component, the outer two blade components are each angled about 22° and both are angled towards each other. Other angles are possible.

Each blade 254 is spaced a distance D from the impeller shaft 224. This spacing additionally creates turbulence within housing 202 as compared to embodiments where D is equal to zero.

Each blade support 252 includes one or more knobs 260. Knobs 260 provide sacrificial mass which can be ground down during manufacture and leaving a flat surface in order to dynamically balance the impeller 250 for the high rpm operation. In contrast, conventional drilling of the impeller 250 to balance mass can weaken the impeller 250 and the drillings, during operation, can accumulate material and cause an imbalance.

As impeller 250 rotates in rotational direction RD, the raw material RM particles within mill 200 contact the moving, cupped surface of blades 252. Because of the geometry of the blade 252 surface and the cross-sectional shape of the lateral area 220, the impact angles of the raw material RM particles varies. This pulsation and variance within the rebound angles of incidence creates a large number of collisions, for example, hundreds of collisions, within a given space resulting only from the initial collision of the raw material RM particle with the surface of the moving blade 252. Thereby, the collisions between the raw material RM particles themselves causes wear and grinding on those particles, which reduces wear and stress on the mill 200 components. In embodiments, most of the wearing or grinding of raw material RM particles occurs through these particle-to-particle collisions.

Figure 14:
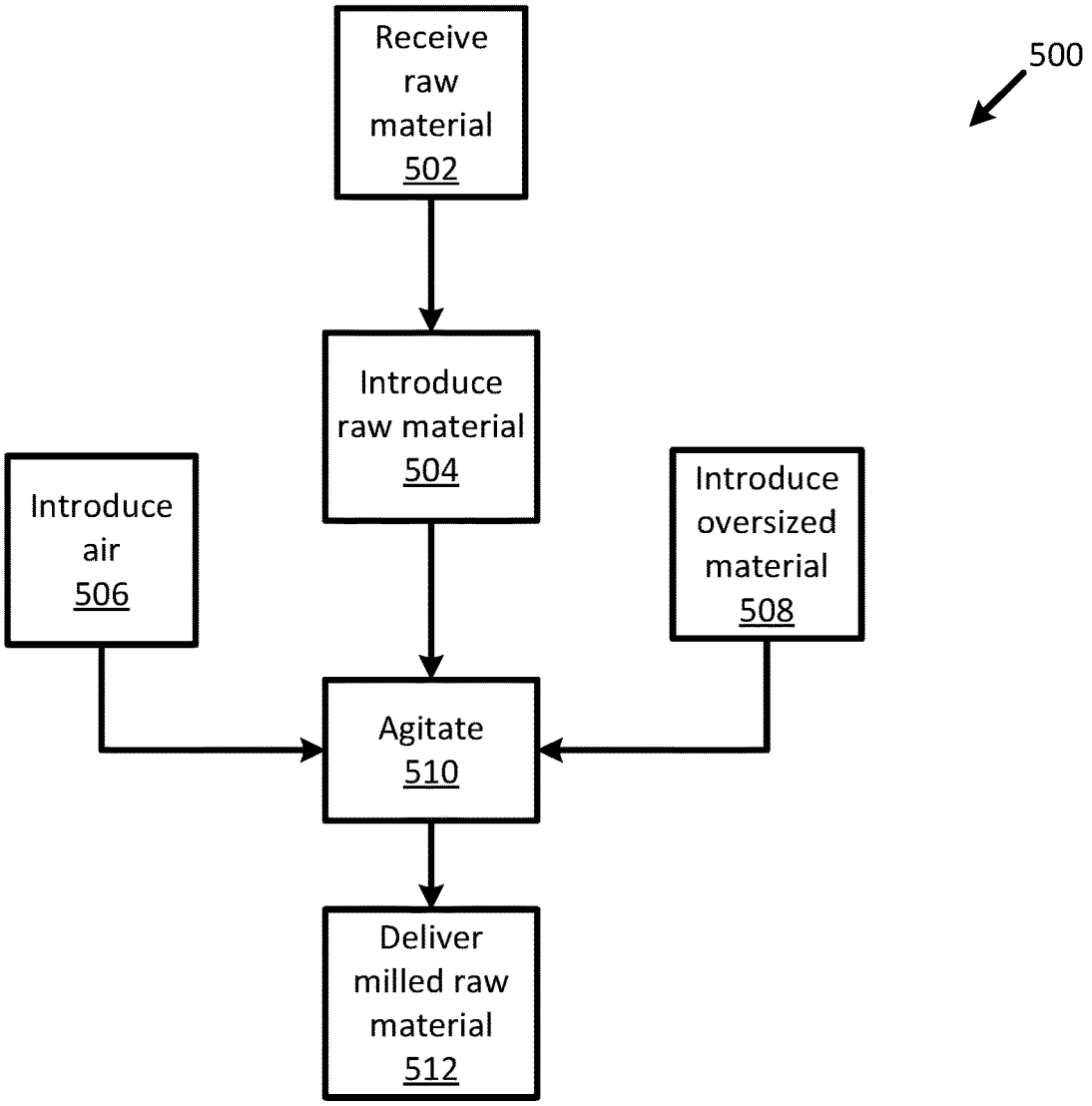
FIG. 14 is a flowchart illustrating a method for milling a raw mining material.

FIG. 14 illustrates an embodiment of an example method 500 for milling raw material. The example method 500 includes receiving raw material (operation 502), introducing raw material (operation 504), introducing air (operation 506), introducing oversized material (operation 508), agitating (operation 510), and delivering milled raw material (operation 512). The example mill shown in, and described with reference to, FIGS. 2-13 can be used in the implementation of example method 500. Other embodiments can include more or fewer operations.

The example method 500 begins by the mill receiving raw material (operation 502) and introducing the raw material into the mill (operation 504). Raw material includes, as discussed above, mined raw material containing heavy or precious metals. The raw material has a first size range such as those discussed above with reference to FIGS. 1-14.

Mill receives raw material (operation 502) from, for instance, a hopper containing mined raw material. Metering the introduction of raw material (operation 504) into mill is accomplished by virtue of the size of inlet and gravitational forces on raw material in hopper, by the rate introduced by a delivery mechanism, such as a conveyor belt, and/or by a valve.

Concurrently, air is introduced into the mill (operation 506). Air is routed from the outlet(s) of post-milling equipment, such as a classification cyclone, to the inlet of the mill. Air facilitates the movement of raw material through the mill. Additionally, air, in combination with the impeller, creates agitation forces such as vortices within the mill, and these forces contribute to the size reduction of raw material as it passes through the mill.

Additionally, oversized raw material is introduced into the mill (operation 508). Oversized raw material is likely the same or similar size to the raw material introduced in operation 504. However, it is raw material that has already passed through mill at least once, and, in embodiments, enters the mill through a separate inlet. The oversized material was separated out at a subsequent processing step, for example, an air classification system whereby centrifugal and/or cyclonic forces classify material to a predetermined size.

Raw material that enters mill is then agitated (operation 510). Mill agitates the raw material via the air returned from the additional separation systems and the impeller rotating to create turbulence within the mill. The turbulence can include one or more vortices within the mill. Agitation causes a reduction in size of some, most, or all of the raw material introduced into the mill to a second size range, the second size range having been discussed above with reference to FIGS. 1-14.

During agitation (operation 510), impeller is rotated at about 2000 rotations per minute (rpm); at about 2500 rpm; at about 3000 rpm; at about 3250 rpm; at about 3500 rpm; or at about 4000 rpm.

When the raw material has moved from the inlet of the mill to the outlet of the mill, it is delivered to a subsequent processing system (operation 512). In embodiments, raw material passes through a volute or spiral-shaped portion at the mill outlet. As mentioned above, subsequent processing can include a separation process that sends oversized material back to the mill for introduction in operation 508. Further, subsequent processing can include other physical and chemical processes designed to isolate the heavy or precious metals contained within the matrix.

Figure 15:
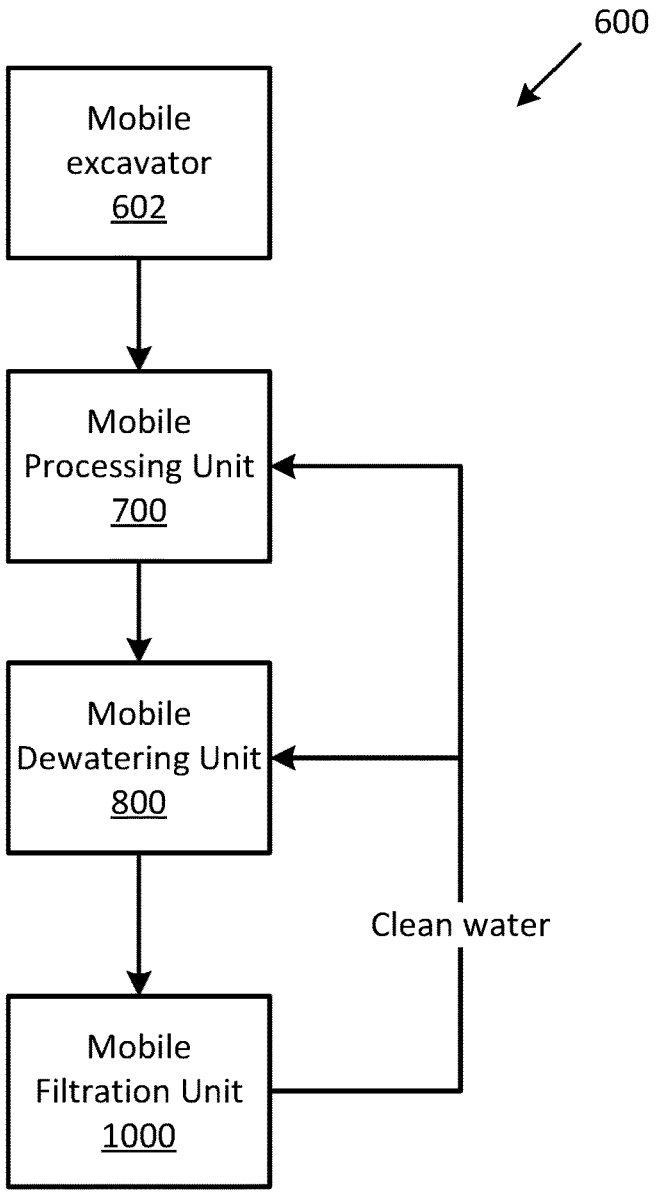
FIG. 15 is a general-purpose block diagram of an example mobile mining system.

Referring now to FIG. 15, a general block diagram of an example mobile mining system 600 is provided. As illustrated, the mobile mining system 600 generally includes a mobile excavator 602, a mobile processing unit 700, a mobile dewatering unit 800, and a mobile filtration unit 1000. Each unit 700, 800 and 1000 can be configured to include an integrated power source. Each unit 700, 800 and 1000 can be configured to be automated and operated remotely by using a wireless-enabled device, such as, for example, a cellular phone, a tablet computer, a laptop computer, a dedicated remote device, or any other device with a processor, memory and network connectivity capability. In some embodiments, one or more operators can control one or more of units 700, 800 and 1000 in a central operating location, in the mobile excavator 602 or near the mining operation. Additional details regarding one or more possible embodiments of a mobile mining system in which the mill 104 can be integrated are discussed in U.S. patent application Ser. No. 14/097,889, the disclosure of which is hereby incorporated by reference in its entirety.

A mobile mining system 600 is advantageous for many reasons. Among them is that operational expenditures can be reduced because, for example, there is no hauling of material to and from a stationary plant, there is reduced loading and handling of run of mine and tails material, and there is a reduction in the personnel required to operate the mine and plant. Capital expenditures can be reduced because, for example, stationary infrastructure such as a plant or tailings pond is not required and there is a reduction in the quantity of plant equipment and rolling stock. Because there is minimal discharge and no tailings pond is required, the permitting process can be simplified or streamlined. For at least those reasons and because there is no permanent structure required in most embodiments, the environmental impact is also reduced. Additionally, in some embodiments, there is no need to construct haul roads and the reduced operational area minimizes the operational area.

Moreover, the mobile mining system 600 can be advantageous for its self-sufficiency because the integrated power and water filtration systems can enable off-grid operation. In some embodiments, over 95% of the process water is recycled, so not only can the mobile mining system 600 conserve water usage, it can also be useful in arid environments where water can be transported to the location and recycled.

Mobile excavator 602 can be any mobile mining excavating apparatus known to one of ordinary skill in the art.

The mobile processing unit 700 generally receives raw mining materials from the mobile excavator 602 as well as water from the mobile filtration unit 1000. The mobile processing unit 700 can also be configured to receive clean water from one or more sources in addition to the mobile filtration unit. The mobile processing unit 700 can be track mounted, mounted on a trailer, or arranged in a transportable and/or mobility-enabled configuration. An example embodiment of the mobile processing unit 700 is shown and described in more detail with reference to FIG. 16.

The mobile dewatering unit 800 generally receives the output from the mobile processing unit 700 as well as clean water from the mobile filtration unit 1000 or other water source. The mobile dewatering unit 800 can be track mounted, mounted on a trailer, or arranged in a transportable and/or mobility-enabled configuration. An embodiment of the mobile dewatering unit 800 is shown and described in more detail with reference to FIG. 17.

The mobile filtration unit 1000 generally receives the output from the mobile dewatering unit 800. The mobile filtration unit 1000 in example mobile mining system 600 is configured to route clean water to either, or both, the mobile processing unit 700 and the mobile dewatering unit 800. The clean water can be the product of the processing performed by the mobile filtration unit 1000 and/or sourced from a water supply, such as, for example, a pond or storage tank.

Figure 16:
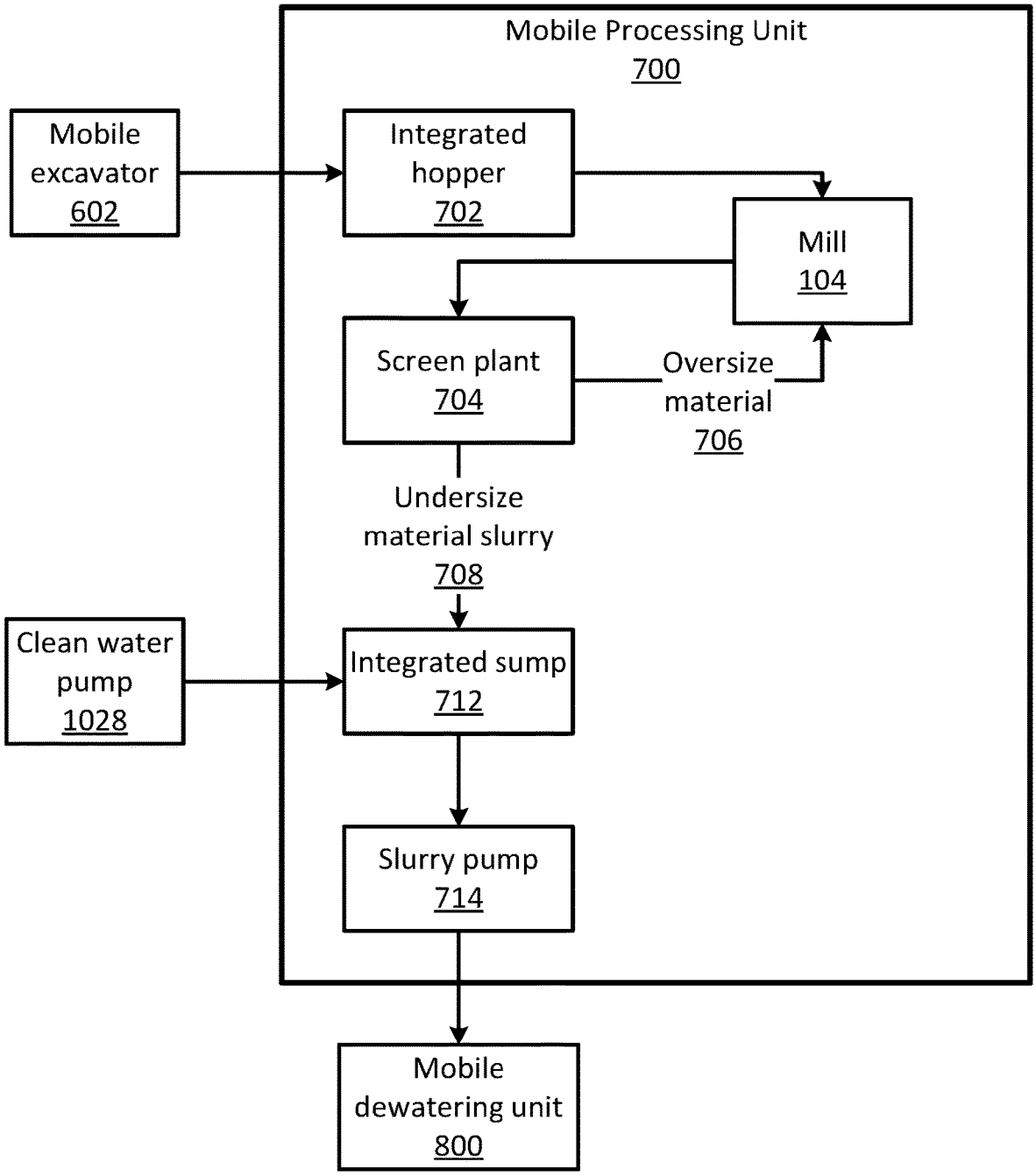
FIG. 16 is a block diagram illustrating a general progression of mining materials and water through an example embodiment of a mobile processing unit.

FIG. 16 illustrates an example embodiment of the mobile processing unit 700. The example mobile processing unit 700 includes an integrated hopper 702, a screen plant 704, an integrated sump 712 and a slurry pump 714. The example embodiment of the mobile processing unit 700 can also be used with mill 104. Other embodiments may have additional or fewer components. In some embodiments, the mobile processing unit 700 separates heavy metals from the excavated raw mining materials. The mobile processing unit 700 can be configured to route the waste water and tailings output to the mobile dewatering unit 800 instead of a traditional settling pond.

The integrated hopper 702 is configured to receive raw mining materials from the mobile excavator 602. Integrated hopper 702 can also receive raw material output from mill 104. The integrated hopper 702 feeds into the mill 104, where the raw material is processed. The output from mill 104 goes to screen plant 704. In some embodiments, the integrated hopper 702 receives water from a stand-alone water source alone or in conjunction with the water reclamation subsystems 800 and 1000.

The screen plant 704 washes and classifies the mining materials. The screen plant 704 separates the fluidized mining materials into oversize materials 706 and an undersize material slurry 708. The oversize materials are generally more than 0.25 inch diameter; more than 0.3 inch diameter; more than 0.2 inch diameter; or more than 0.4 inch diameter. The oversize material is rejected and deposited into a waste pile, not part of mobile processing unit 700, or onto a conveyor 710. In embodiments, oversize materials 706 is routed to mill 104 for further size reduction, and then mill 104 outputs the processed raw material back to the screen plant 704. The undersize material 708 flows through the screens as slurry and into the integrated sump 712.

The integrated sump 712 receives the undersize material slurry 708 from the screen plant 704. The integrated sump 712 also receives water from the clean water pump 1028. In this embodiment, the sump 712 is integrated into the screen plant 704.

The slurry pump 714 draws the undersize material slurry 708 from the integrated sump 712. The slurry pump 714 routes the undersize material slurry 708 to the mobile dewatering unit 800. The slurry pump 714 can be sized to handle the anticipated production rate of the mobile processing unit 700. Some embodiments employ more than one slurry pumps.

In some embodiments, the components of the mobile processing unit are powered by a power source supported by the mobile processing unit 700. Additionally, the mobile processing unit 700 optionally includes means for self-propulsion. In those embodiments, the integrated power source provides motive power to the tracks in addition to the components comprising the processing unit. Alternative embodiments can use wheels instead of tracks or a combination of wheels and tracks.

The mobile processing unit 700 optionally includes an integrated conveyor. Oversize material 706 from screen plant 704 is deposited onto the conveyor. Conveyor can in turn deposit the waste onto a pile or a container for disposal.

Figure 17:
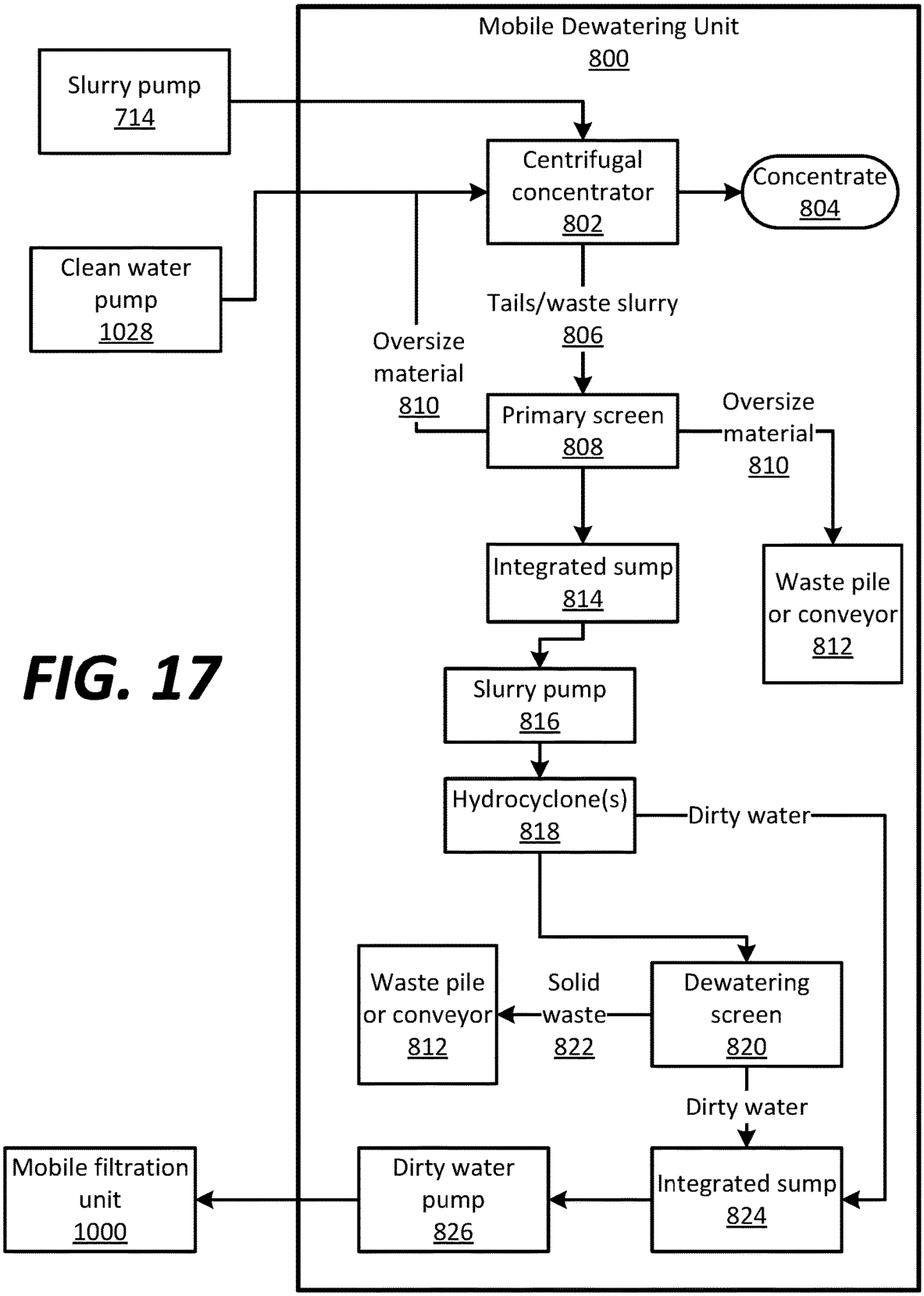
FIG. 17 is a block diagram illustrating a general progression of mining materials and water through an example embodiment of a mobile dewatering unit.

FIG. 17 illustrates an example embodiment of the mobile dewatering unit 800. In one embodiment, the mobile dewatering unit 800 includes a centrifugal concentrator 802, a primary screen 808, a waste pile or conveyor 812, an integrated sump 814, a slurry pump 816, one or more hydrocyclones 818, a dewatering screen 820, an integrated sump 824, and a dirty water pump 826. Other embodiments may have additional or fewer components. In some embodiments, the mobile dewatering unit is configured to receive a slurry mixture via the slurry pump 714 and/or clean water from the clean water pump 1028.

The centrifugal concentrator 802, also known as a gravimetric concentrator, can be configured to receive the output from the slurry pump 714 and water from the clean water pump 1028. The centrifugal concentrator 802 uses centrifugal force to separate the heavier material from the lighter material. The heavier material is collected from the centrifugal concentrator 802 as a concentrate 804 and processed further in a not-shown process. The lighter material flows from the concentrator with the process water as a tails/waste slurry 806 onto a primary screen 808.

The primary screen 808, also known as an integrated dewatering screen, separates the water from the solids. The solids, or oversize material 810, are deposited onto an integrated conveyor 812 or deposited directly onto the ground in a waste pile. The oversize material is, in some embodiments, material with a diameter more than about ⅙ inch; more than ⅐ inch; or more than ⅕ inch. The water from the primary screen 808 contains, in embodiments, smaller suspended solids.

The integrated sump 814 receives the water from the primary screen 808. The slurry pump 816 draws from the integrated sump 814 as its intake for routing the water to the one or more hydrocyclones 818.

The one or more hydrocyclones 818 can be configured to operate in parallel or in sequence. The one or more hydrocyclones 818 receive the water from the slurry pump 816 and remove the majority of the suspended solids, which are directed to the underflow of the one or more hydrocyclones 818. The one or more hydrocyclones have a dirty water output and a separate solids output. The dirty water is routed to the integrated sump 824.

The solids from the one or more hydrocyclones are deposited onto the dewatering screen 820 and/or the primary screen. The solid waste 822 from the screen 808 or 820 is sent to the conveyor 812 or waste pile. The dirty water output from the screen 808 or 820 is routed to the integrated sump 824.

The integrated sump 824 receives the dirty water from the hydrocyclones 818 and/or the dewatering screen 808 or 820. A dirty water pump 826 is fluidly connected to the integrated sump 824 and routes the dirty water to the mobile filtration unit 1000 or to a water treatment tank or other location.

In some embodiments, the integrated sump 824 has two pumps drawing from it, not shown in FIG. 17. A first pump sends the dirty water to the mobile filtration unit 1000 or a water treatment tank. A second pump can recirculate the water to the hydrocyclones 818 or to a different, smaller bank of one or more hydrocyclones to remove more of the water.

The mobile dewatering unit 800 optionally includes an integrated power source. Additionally, the mobile dewatering unit 800 optionally includes means for self-propulsion, such as tracks. In those embodiments, the integrated power source provides motive power to the tracks and/or wheels in addition to the components comprising the filtration unit. Alternative embodiments can use wheels instead of tracks or a combination of wheels and tracks.

The mobile dewatering unit 800 optionally includes an integrated conveyor. Oversize material 810 and solid waste 822 from screen 808 and/or 820 are deposited onto the conveyor. Conveyor can in turn deposit the waste onto a pile or a container for disposal.

Figure 18:
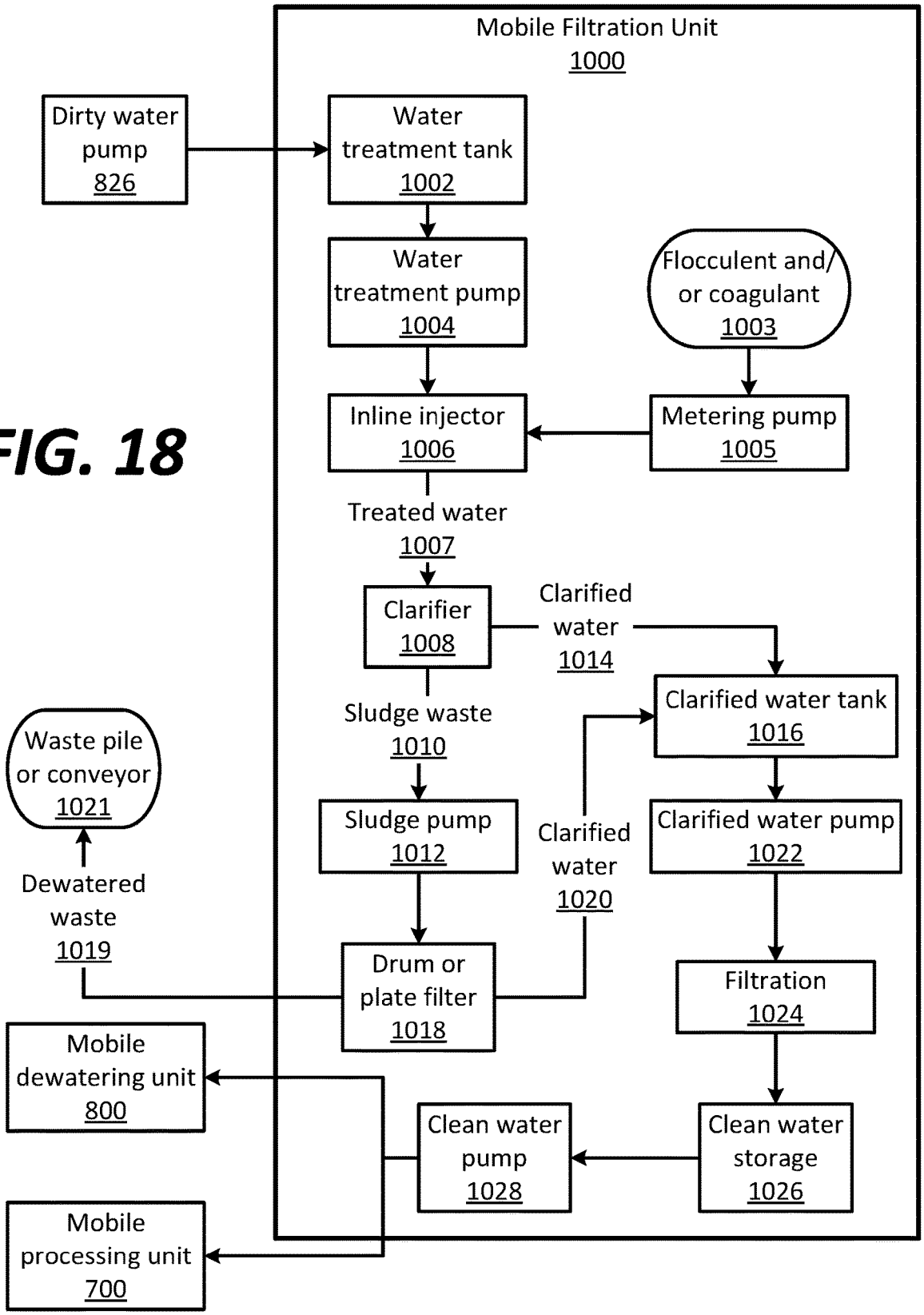
FIG. 18 is a block diagram illustrating a general progression of mining materials and water through an example embodiment of a mobile filtration unit.

FIG. 18 illustrates an example embodiment of a mobile filtration unit 1000. In one embodiment, the mobile filtration unit 1000 includes a water treatment tank 1002, a water treatment pump 1004, flocculent and/or coagulant storage 1003, a metering pump 1005, an inline injector 1006, a clarifier 1008, a sludge pump 1012, a drum or plate filter 1018, a clarified water tank 1016, a clarified water pump 1022, filtration 1024, clean water storage 1026, and clean water pump 1028. Other embodiments may have additional or fewer components. In some embodiments the mobile filtration unit 1000 is configured to receive dirty water from the dirty water pump 826. In embodiments, the mobile filtration unit 1000 is mounted to a trailer.

The water treatment tank 1002 is configured to receive dirty water from the dirty water pump 826, located in the mobile dewatering unit 800. A water treatment pump 1004 draws the dirty water from the water treatment tank 1002 and pumps the dirty water through an inline injector 1006.

One or more metering pumps 1005 can operate in series or parallel and meter a measured amount of flocculent and/or coagulant 1003 into the dirty water. The flocculent and/or coagulant 1003 can be stored in containers from which the one or more metering pumps 1005 draw their intake.

The clarifier 1008 receives the resulting treated water 1007, comprising the dirty water, flocculent and/or coagulant. In various embodiments, the clarifier 1008 is a separate and mobile component of the mobile filtration unit 1000. At the clarifier 1008, the treated water is settled for a given period of time. A result of the settling period is that the suspended solids settle out from the dirty water. The underflow of the clarifier 1008 is a sludge waste 1010 comprising the settled suspended solids.

A sludge pump 1012 routes the sludge waste 1010 from the clarifier 1008 to a filter press or rotary drum press 1018 (drum or plate filter). The drum or plate filter 1018 removes the majority of the water from the sludge waste 1010. The resulting dewatered waste 1019 can be stacked or conveyed to a waste pile 1021.

The clarified water 1014 from the clarifier 1008, the overflow, is routed to a clarified water tank 1016. The clarified water tank 1016 has a clarified water pump 1022 that draws from the tank 1016 and directs the water through a one or more disc or media filters 1024. The one or more filters 1024 can be operated in series or in parallel.

The clean water storage 1026 receives the clean water from the one or more filtration 1024 components. The clean water pump 1028 draws from the clean water storage 1026 and pumps the recycled clean water to the mobile processing unit 700 and/or the mobile dewatering unit 800.

Figure 19:
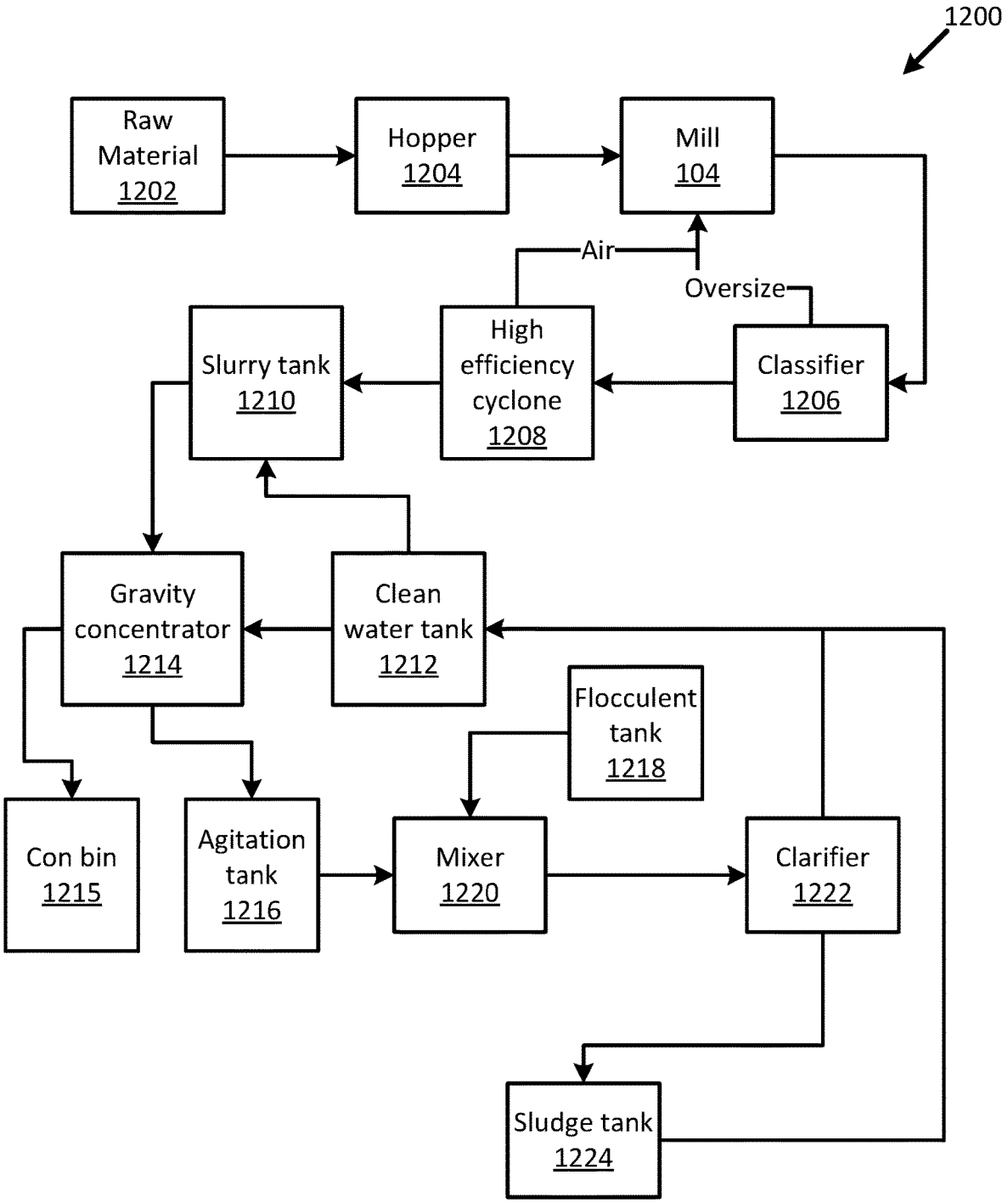
FIG. 19 is a block diagram illustrating a general progression of mining materials and water through another example embodiment of a materials processing system.

FIG. 19 illustrates an embodiment of an example method 1200 for processing raw material. The example method 1200 includes raw material 1202, hopper 1204, mill 104, classifier 1206, high efficiency cyclone 1208, slurry tank 1210, clean water tank 1212, gravity concentrator 1214, agitation tank 1216, flocculent tank 1218, mixer 1220, clarifier 1222, and sludge tank 1224. Other embodiments can include more or fewer components.

Raw material 1202 is fed to hopper 1204. In embodiments, raw material is less than ⅜ inch in size. The hopper 1204 then feeds raw material into the mill 104, where the raw material is reduced in size. The output from mill 104 includes pressurized air and milled raw material, both of which are fed into classifier 1206.

Classifier 1206 includes two outputs. An oversize output feeds oversized material back to mill 104 for further processing. In embodiments, oversized material is greater than 150 microns. The oversized material can be metered into the mill 104 via an air lock valve.

A second output of classifier 1206 sends pressurized air and processed material to the high efficiency cyclone 1208. In embodiments, the processed material sent from classifier 1206 to the high efficiency cyclone 1208 is less than 150 microns in size.

The high efficiency cyclone 1208 includes two outlets. A first outlet of the high efficiency cyclone 1208 returns pressurized air to the mill 104. In embodiments, the air flow is between 4000 cubic feet per minute and 6000 cubic feet per minute. A second outlet of the high efficiency cyclone 1208 sends processed material to a slurry tank 1210. The processed material can be metered into the slurry tank 1210 via an air lock valve. In embodiments, the processed material is fed at a rate of 15 tons per hour.

The slurry tank 1210 includes a mixer that mixes the processed material and water received from the clean water tank 1212. In embodiments, water is pumped from the clean water tank 1212 at a rate of about 66 gallons per minute (gpm) into the slurry tank 1210.

The mixture in the slurry tank 1210 is pumped to the gravity concentrator 1214. In embodiments, the slurry is pumped to the gravity concentrator at a rate of about 100 gpm, where the slurry is about 44% solids by volume. The gravity concentrator 1214 has two outputs. A first output of the gravity concentrator 1214 goes to a concentrate bin 1215. A second output of the gravity concentrator 1214 goes to an agitation tank 1216. In embodiments, the concentrate bin 1215 holds the desired material, such as a precious metal like gold. In embodiments, the second output of the gravity concentrator 1214 has a flow rate of 100 gpm.

The agitation tank 1216 includes a mixer and its contents are pumped to a mixer 1220. In embodiments, the agitation tank 1216 contents are pumped at about 100 gpm. The mixer mixes the output from the agitation tank 1216 with flocculent from a flocculent tank 1218.

The output from mixer 1220 is sent to the clarifier 1222. Water from the clarifier 1222 is pumped back to the clean water tank 1212. Solids from the clarifier 1222 are pumped to a sludge tank 1224. In embodiments, the solids are pumped to the sludge tank at a rate of 70 gpm with a 62% solids content. Last, water from the sludge tank 1224 is pumped back to the clean water tank 1212.

In an example embodiment, a computing system is used to control the systems of FIGS. 1-19. In general, the computing system includes a processor communicatively connected to a memory via a data bus. The processor can be any of a variety of types of programmable circuits capable of executing computer-readable instructions to perform various tasks, such as mathematical and communication tasks. The memory can include any of a variety of memory devices, such as using various types of computer-readable or computer storage media. A computer storage medium or computer-readable medium may be any medium that can contain or store the program for use by or in connection with the instruction execution system, apparatus, or device. In the context of the present disclosure, a computer storage medium includes at least some tangible component, i.e., is not entirely consisting of transient or transitory signals.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A mill for reducing the size of raw mining materials, comprising:

a housing having a first end portion, a second end portion opposite the first end portion and separated from the first end portion by a mill length along a longitudinal axis in a longitudinal direction, and a lateral area disposed between the first end portion and the second end portion, the housing including:

a material inlet;

an air inlet;

a material outlet; and a recirculated material inlet, wherein each of the material inlet, the air inlet and the recirculated material inlet are positioned near the first end portion, and wherein the material outlet is positioned near the second end portion; and an impeller positioned within the housing, wherein the impeller includes:

a shaft disposed along a longitudinal axis and extending in the longitudinal direction between the first end portion and the second end portion;

a plurality of impeller blade supports extending radially from the shaft and positioned spaced apart along the shaft; and a plurality of impeller blades mounted to the plurality of impeller blade supports and radially spaced apart from the shaft, each of the plurality of impeller blades extending in the longitudinal direction and mounted to each of the plurality of impeller blade supports;

wherein each of the plurality of impeller blades forms a cross section having a concave impacting surface oriented towards a rotational direction of the plurality of impeller blades.

2. The mill of claim 1, wherein a cross section of the lateral area is a polygon including a plurality of lateral faces, the cross section of the lateral area having a centroid;

wherein the shaft passes through the centroid; and wherein the air inlet is positioned adjacent to the shaft.

3. The mill of claim 2, wherein the polygon is a regular octagon; and wherein a portion of the material outlet has a volute shape.

4. The mill of claim 1, wherein the housing includes a plurality of support ribs;

wherein the housing includes a plurality of wear plates, the wear plates being substantially planar; and wherein the plurality of wear plates are connected to the inner surface of the lateral area.

5. The mill of claim 4, wherein the mill, when fully assembled, has an area of less than 6000 square inches.

6. A mill for reducing the size of raw mining materials, comprising:

a housing having a first end portion, a second end portion opposite the first end portion and separated from the first end portion by a mill length in a longitudinal direction, and a lateral area disposed between the first end portion and the second end portion, the housing including:

a material inlet;

an air inlet;

a material outlet, wherein a portion of the material outlet has a volute shape; and a recirculated material inlet, wherein each of the material inlet, the air inlet and the recirculated material inlet are positioned near the first end portion, and wherein the material outlet is positioned near the second end portion; and an impeller positioned within the housing, wherein the impeller includes:

a shaft disposed along a longitudinal axis and extending in the longitudinal direction between the first end portion and the second end portion;

a plurality of impeller blade supports extending radially from the shaft and positioned spaced apart along the shaft; and a plurality of impeller blades mounted to the plurality of impeller blade supports and radially spaced apart from the shaft, each of the plurality of impeller blades extending in the longitudinal direction and mounted to each of the plurality of impeller blade supports;

wherein each of the plurality of impeller blades forms a cross section having a concave impacting surface oriented towards a rotational direction of the plurality of impeller blades;

wherein a cross section of the lateral area is a polygon including a plurality of lateral faces, the cross section of the lateral area having a centroid;

wherein the shaft passes through the centroid; and wherein the air inlet is positioned adjacent to the shaft.

7. The mill of claim 6, wherein the polygon is a regular octagon; and wherein a portion of the material outlet has a volute shape.

8. A mill for reducing the size of raw mining materials, comprising:

a housing having a first end portion, a second end portion opposite the first end portion and separated from the first end portion by a mill length in a longitudinal direction, and a lateral area disposed between the first end portion and the second end portion, the housing including:

a material inlet;

an air inlet;

a material outlet, wherein a portion of the material outlet has a volute shape; and a recirculated material inlet, wherein each of the material inlet, the air inlet and the recirculated material inlet are positioned near the first end portion, and wherein the material outlet is positioned near the second end portion; and an impeller positioned within the housing, wherein the impeller includes:

a shaft disposed along a longitudinal axis and extending in the longitudinal direction between the first end portion and the second end portion;

a plurality of impeller blade supports extending radially from the shaft and positioned spaced apart along the shaft; and a plurality of impeller blades mounted to the plurality of impeller blade supports and radially spaced apart from the shaft, each of the plurality of impeller blades extending in the longitudinal direction and mounted to each of the plurality of impeller blade supports;

wherein each of the plurality of impeller blades forms a cross section having a concave impacting surface oriented towards a rotational direction of the plurality of impeller blades;

wherein the housing includes a plurality of support ribs;

wherein the housing includes a plurality of wear plates, the wear plates being substantially planar; and wherein the plurality of wear plates are connected to the inner surface of the lateral area.

9. The mill of claim 8, wherein the mill, when fully assembled, has an area of less than 6000 square inches.

* * * * *